US011771170B2

(12) United States Patent
Seid

(10) Patent No.: US 11,771,170 B2
(45) **Date of Patent: *Oct. 3, 2023**

(54) ARTICLES OF FOOTWEAR AND OTHER FOOT-RECEIVING DEVICES HAVING REARWARD TRANSLATING HEEL COMPONENTS

(71) Applicant: NIKE, Inc., Beaverton, OR (US)

(72) Inventor: Aaron K. Seid, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 71 days.

This patent is subject to a terminal disclaimer.

(21) Appl. No.: 17/478,257

(22) Filed: Sep. 17, 2021

(65) Prior Publication Data

US 2022/0031014 A1 Feb. 3, 2022

Related U.S. Application Data

(63) Continuation of application No. 16/445,615, filed on Jun. 19, 2019, now Pat. No. 11,134,746.

(Continued)

(51) Int. Cl.
*A43B 11/00* (2006.01)
*A43B 3/26* (2006.01)

(Continued)

(52) U.S. Cl.
CPC ..... *A43B 11/00* (2013.01); *A43B 3/26* (2013.01); *A43B 23/0295* (2013.01); *A43C 11/00* (2013.01)

(58) Field of Classification Search
CPC ..... A43B 11/00; A43B 3/26; A43B 23/0295; A43C 11/00

(Continued)

(56) References Cited

U.S. PATENT DOCUMENTS 474,574 A 5/1892 Bruzon
537,627 A 4/1895 Bixby et al.

(Continued)

FOREIGN PATENT DOCUMENTS

CN 2052208 U 2/1990
CN 1622770 A 6/2005

(Continued)

OTHER PUBLICATIONS

Sep. 2, 20195—(WO) ISR & WO—App. No. PCT/US19/037939 (005745.02944).

*Primary Examiner* — Ted Kavanaugh
(74) *Attorney, Agent, or Firm* — Banner & Witcoff, Ltd.

(57) ABSTRACT

Footwear includes one or more of: (a) an upper portion at least partially defining a foot-receiving chamber; (b) a track component integrally formed or engaged with the upper portion; (c) a heel engaging component movable with respect to the upper portion via the track component between a closed configuration and an open configuration; (d) a locking system, e.g., holding the heel engaging component in the closed configuration; (e) a biasing system, e.g., applying force to the heel engaging component toward the open configuration; (f) a stop system, e.g., keeping the heel engaging component from completely disengaging from the track component; and/or (g) a sole structure. When the footwear is supported upright on a horizontal surface, the heel engaging component may move rearward (and in some examples upward) via the track component when changing from the closed to the open configuration.

20 Claims, 20 Drawing Sheets

Related U.S. Application Data

(60) Provisional application No. 62/687,056, filed on Jun. 19, 2018.

(51) Int. Cl.
*A43B 23/02* (2006.01)
*A43C 11/00* (2006.01)

(58) Field of Classification Search
USPC ..... 36/138, 105
See application file for complete search history.

(56) References Cited

U.S. PATENT DOCUMENTS

| | | | | |
|---|---|---|---|---|
| 955,337 | A | 4/1910 | Lawlor | |
| 1,686,175 | A | 10/1928 | Read | |
| 2,252,315 | A | 8/1941 | Doree | |
| 2,357,980 | A | 9/1944 | Spiro | |
| 2,450,250 | A | 9/1948 | Napton | |
| 2,815,588 | A * | 12/1957 | Ruane | A43B 11/00 36/138 |
| 3,192,651 | A | 7/1965 | Smith | |
| 3,681,860 | A | 8/1972 | Bidegain | |
| 4,095,356 | A | 6/1978 | Robran et al. | |
| 4,136,468 | A | 1/1979 | Munschy | |
| 4,665,634 | A | 5/1987 | Diaz | |
| 5,184,410 | A | 2/1993 | Hamilton | |
| 5,481,814 | A | 1/1996 | Spencer | |
| 5,557,866 | A | 9/1996 | Prengler | |
| 5,782,015 | A * | 7/1998 | Dananberg | A43B 7/1425 36/35 B |
| 5,813,144 | A | 9/1998 | Prengler | |
| 6,189,239 | B1 | 2/2001 | Gasparovic et al. | |
| 6,594,921 | B2 | 7/2003 | Laio et al. | |
| 7,055,268 | B2 | 6/2006 | Ha | |
| 7,178,270 | B2 | 2/2007 | Hurd et al. | |
| 7,287,294 | B2 | 10/2007 | Miller et al. | |
| 7,448,148 | B2 | 11/2008 | Martinez et al. | |
| 7,607,242 | B2 | 10/2009 | Karandonis et al. | |
| 7,685,747 | B1 | 3/2010 | Gasparovic et al. | |
| 7,793,438 | B1 | 9/2010 | Busse et al. | |
| 8,161,669 | B2 | 4/2012 | Keating | |
| 8,215,030 | B2 | 7/2012 | Bowen et al. | |
| 8,225,534 | B2 | 7/2012 | Mueller et al. | |
| 8,245,421 | B2 | 8/2012 | Baudouin et al. | |
| 9,265,305 | B2 | 2/2016 | Hatfield et al. | |
| 9,414,640 | B2 | 8/2016 | Nichols | |
| 11,134,746 | B2 * | 10/2021 | Seid | A43B 23/0295 |
| 2002/0095823 | A1 * | 7/2002 | Laio | A43B 3/242 36/105 |
| 2005/0039348 | A1 * | 2/2005 | Raluy | A43C 11/00 36/105 |
| 2010/0319216 | A1 | 12/2010 | Grenzke et al. | |
| 2011/0146106 | A1 * | 6/2011 | Kaufman | A43C 11/00 36/43 |
| 2012/0079746 | A1 | 4/2012 | Ferreira et al. | |
| 2014/0298687 | A1 | 10/2014 | Flinterman et al. | |
| 2015/0216252 | A1 | 8/2015 | Wiens | |
| 2017/0042290 | A1 | 2/2017 | Hatfield et al. | |

FOREIGN PATENT DOCUMENTS

| | | | |
|---|---|---|---|
| CN | 102595952 | B | 4/2015 |
| EP | 2848140 | A1 | 3/2015 |
| FR | 2994800 | B1 | 3/2015 |
| KR | 101844276 | B1 | 4/2018 |
| WO | 2014140443 | A1 | 9/2014 |

* cited by examiner

ARTICLES OF FOOTWEAR AND OTHER FOOT-RECEIVING DEVICES HAVING REARWARD TRANSLATING HEEL COMPONENTS

RELATED APPLICATION DATA

This application is a continuation application of U.S. patent application Ser. No. 16/445,615, filed on Jun. 19, 2019, which application claims priority benefits based on U.S. Provisional Patent Appln. No. 62/687,056, filed Jun. 19, 2018. Each of U.S. patent application Ser. No. 16/445,615 and U.S. Provisional Patent Appln. No. 62/687,056 is entirely incorporated herein by reference.

FIELD OF THE INVENTION

The present invention relates to the field of footwear and other foot-receiving devices. More specifically, aspects of the present invention pertain to articles of footwear and other foot-receiving devices that include rearward translating heel components, e.g., that enable easy insertion and removal of a wearer's foot, in some examples, in a "hands-free" manner.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and any contact surface. In addition to attenuating ground reaction forces and absorbing energy, the sole structure may provide traction and control potentially harmful foot motion, such as over pronation. General features and configurations of uppers and sole structures are discussed in greater detail below.

The upper forms a void on the interior of the footwear for receiving the foot. The void has the general shape of the foot, and access to the void is provided at an ankle or foot-insertion opening. The upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture. The midsole, which is traditionally attached to the upper along the upper's entire length, forms the middle layer of the sole structure and serves a variety of purposes that include controlling foot motions and attenuating impact forces. The outsole forms the ground-contacting element of footwear and usually is fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, the degree of ground reaction force attenuation, and the energy absorption properties may be altered to meet the specific demands of the activity for which the footwear is intended to be used.

Terminology/General Information

First, some general terminology and information is provided that will assist in understanding various portions of this specification and the technology as described herein. As noted above, the present invention relates to the field of footwear and other foot-receiving devices, including securing systems for such devices. "Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include: (a) one or more "foot-covering members" (e.g., akin to and including footwear upper components) that help position the foot with respect to other components or structures and (b) one or more "foot-supporting members" (e.g., akin to and including footwear sole structure components) that support at least some portion(s) of a plantar surface of a user's foot. "Securing systems," like those in accordance with at least some aspects of this technology, may help position and/or securely hold the user's foot in place with respect to the foot-covering member(s) and/or the foot-supporting member(s). "Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, track shoes, track field event shoes (e.g., for high jump, triple jump, etc.), etc.), and the like. "Foot-supporting members" may include components for and/or functioning as midsoles and/or outsoles for articles of footwear (or components providing corresponding functions in non-footwear type foot-receiving devices).

FIG. 4 also provides information that may be useful for explaining and understanding the specification and/or aspects of this technology. More specifically, FIG. 4 provides a representation of a footwear/foot-receiving device component 100, which in this illustrated example constitutes a portion of a sole structure for an article of footwear. The same general definitions and terminology described below may apply to footwear and foot-receiving devices in general and/or to other footwear/foot-receiving device components or portions thereof, such as an upper, a midsole component, an outsole component, etc.

First, as illustrated in FIG. 4, the terms "forward" or "forward direction" as used herein, unless otherwise noted or clear from the context, mean toward or in a direction toward a forward-most toe area FT of the footwear or foot-receiving device structure or component 100. The terms "rearward" or "rearward direction" as used herein, unless otherwise noted or clear from the context, mean toward or in a direction toward a rear-most heel area RH of the footwear or foot-receiving device structure or component 100. The terms "lateral" or "lateral side" as used herein, unless otherwise noted or clear from the context, mean the outside or "little toe" side of the footwear or foot-receiving device structure or component 100. The terms "medial" or "medial side" as used herein, unless otherwise noted or clear from the context, mean the inside or "big toe" side of the footwear or foot-receiving device structure or component 100.

Also, various example features and aspects of this technology are disclosed or explained herein with reference to a "longitudinal direction" and/or with respect to a "longitudinal length" L of a footwear/foot-receiving device component 100 (such as an article of footwear and/or a footwear sole structure). As shown in FIG. 4, the "longitudinal direction" is determined as the direction of a line extending from a rearmost heel location (RH in FIG. 4) to the forwardmost toe location (FT in FIG. 4) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, e.g., as part of an article of footwear or foot-receiving device) is oriented on a horizontal support surface S in an unloaded condition (e.g., with no weight applied to it other than potentially the weight of the shoe/foot-receiving device components with which it is engaged). If the forwardmost and/or rearmost locations of a specific footwear or foot-receiving device component 100 constitute a line segment (rather than a tangent point), then the forwardmost toe location and/or the rearmost heel location constitute the mid-point of the corresponding line segment. If the forwardmost and/or rearmost locations of a specific footwear or foot-receiving device component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S, planes may be oriented perpendicular to this longitudinal direction (e.g., planes running into and out of the page of FIG. 4). The locations of these perpendicular planes may be specified based on their positions along the longitudinal length L where the perpendicular plane intersects the longitudinal direction between the rearmost heel location RH and the forwardmost toe location FT. In this illustrated example of FIG. 4, the rearmost heel location RH is considered as the origin for measurements (or the "0L position") and the forwardmost toe location FT is considered the end of the longitudinal length of this component (or the "1.0L position"). Plane position may be specified based on its location along the longitudinal length L (between 0L and 1.0L), measured forward from the rearmost heel RH location in this example. FIG. 4 further shows locations of various planes perpendicular to the longitudinal direction (and oriented in the "transverse direction," i.e., perpendicular to the longitudinal direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 4, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 4. The "transverse direction" on a footwear component may be perpendicular to the longitudinal direction and parallel to the horizontal support surface and/or extending along a surface of the footwear component.

BRIEF DESCRIPTION OF THE DRAWINGS

The following Detailed Description will be better understood when read in conjunction with the accompanying drawings in which like reference numerals refer to the same or similar elements in all of the various views in which that reference number appears.

Figure 1A:
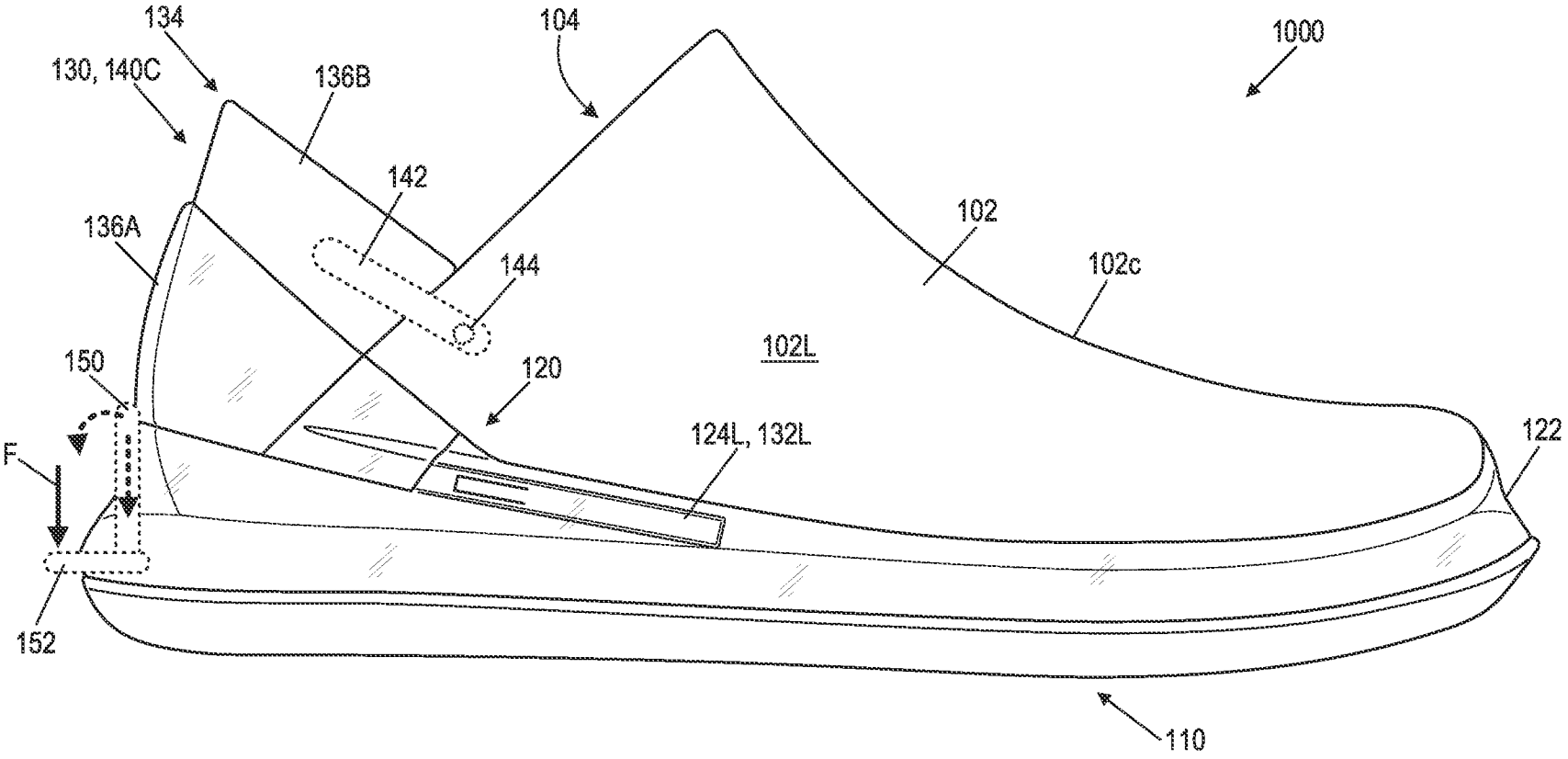
FIGS. 1A through 1L provide various views of articles of footwear and/or components thereof in accordance with some examples and aspects of this technology.

The reader should understand that the attached drawings are not necessarily drawn to scale.

DETAILED DESCRIPTION

In the following description of various examples of footwear and foot-receiving device structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. Detailed Description of Example Articles of Footwear or Other Foot-Receiving Devices Including this Technology Referring to the figures and following discussion, various articles of footwear/foot-receiving devices and features thereof in accordance with aspects of the present technology are disclosed. The footwear depicted and discussed are athletic shoes, and the concepts disclosed with respect to this footwear may be applied to a wide range of athletic footwear styles, including, but not limited to: walking shoes, tennis shoes, golf shoes, soccer shoes, football shoes, basketball shoes, running shoes, track shoes, shoes for track field events (e.g., high jump, triple jump, etc.) and cross-training shoes. In addition, the concepts of the present technology may be applied to a wide range of non-athletic footwear, including work boots, sandals, loafers, and dress shoes, as well as to other foot-receiving devices.

Articles of footwear and/or other foot-receiving devices in accordance with at least some aspects of this technology may include: (a) an upper portion (or other foot-covering member part) formed of one or more parts, wherein the upper portion/foot-covering member includes a lateral side and a medial side, and wherein the upper portion/foot-covering member part at least partially defines a front part of a foot-receiving chamber for the article of footwear/foot-receiving device; (b) a track component integrally formed or engaged with the upper portion/foot-covering member part; (c) a heel engaging component movable with respect to the upper portion/foot-covering member part via the track component between a closed configuration and an open configuration; and/or (d) a sole structure (or other foot-supporting member) providing a ground-contacting surface/support base for the article of footwear/foot-receiving device and engaged with at least one of the upper portion/foot-covering member part, the track component, or the heel engaging component. When the article of footwear/foot-receiving device is supported in an upright position on the ground-contacting surface/support base of the sole structure/foot-supporting member on a horizontal support surface, the track component is configured to support movement of the heel engaging component rearward when changing from the closed configuration to the open configuration. Additionally, in some examples of this technology, when oriented as described above, the track component may be configured to support movement of the heel engaging component upward when changing from the closed configuration to the open configuration.

The "track component" may include one or more tracks, including, for example, a lateral side track extending along the lateral side of the upper portion/foot-covering member and/or a medial side track extending along the medial side of the upper portion/foot-covering member. The heel engaging component may engage the one or more tracks, and in some examples may include: a lateral rail that is movably engaged with respect to the lateral side track, a medial rail that is movably engaged with respect to the medial side track, and a rear component extending between the lateral rail and the medial rail (and around a rear heel area of the article of footwear/foot-receiving device). The heel engaging component is movable between the closed configuration and the open configuration by moving the lateral rail with respect to the lateral side track (e.g., rearward and/or upward) and/or by moving the medial rail with respect to the medial side track (e.g., rearward and/or upward).

In at least some examples of this technology, the article of footwear/foot-receiving device may include a locking system. This locking system, for example, may have one or more parts engaging the heel engaging component to hold the heel engaging component in the closed configuration (e.g., against the biasing force of a biasing system that applies a force to push the heel engaging component rearward and/or upward). The locking system may include a release mechanism, and, in some examples, an activator portion of the release mechanism may be located at a rear heel area of the article of footwear (e.g., engaged, at least in part, with the sole structure/foot-supporting member and/or the heel engaging component). This locking system may be configured to be engaged by the wearer's other foot, in at least some examples. Additionally or alternatively, a locking system may be provided in the track(s) and/or engaging the rail(s) of the heel engaging component.

Some examples of this technology further may include one or both of a biasing system and/or a stop system. When a biasing system is present, it may apply a force to the heel engaging component that tends to push the heel engaging component toward the open configuration (e.g., so that the heel engaging component will automatically move to the open configuration when permitted to do so, e.g., when the locking system is released). Additionally or alternatively, the article of footwear/foot-receiving device may include a stop system that will prevent the heel engaging component from completely disengaging from the track component and/or from the upper portion(s)/foot-covering member part(s). For example, if desired, the heel engaging component may extend rearward (e.g., under the biasing force of the biasing system or by a force applied by a wearer) until the stop system engages (e.g., to keep the rail(s) engaged with/within the track component(s)). The stop system may be structured to allow complete removal of the heel engaging component from the upper/foot covering member and/or track component(s), e.g., if a user desires.

Still additional aspects of this technology relate to methods of making and/or methods of using articles of footwear and/or other foot-receiving devices, e.g., of the types and having the structures described above (and described in more detail below).

Given the above background and general description of aspects and examples of this technology, a more detailed description of specific examples of articles of footwear in accordance with at least some examples of this technology follows.

Figure 1B:
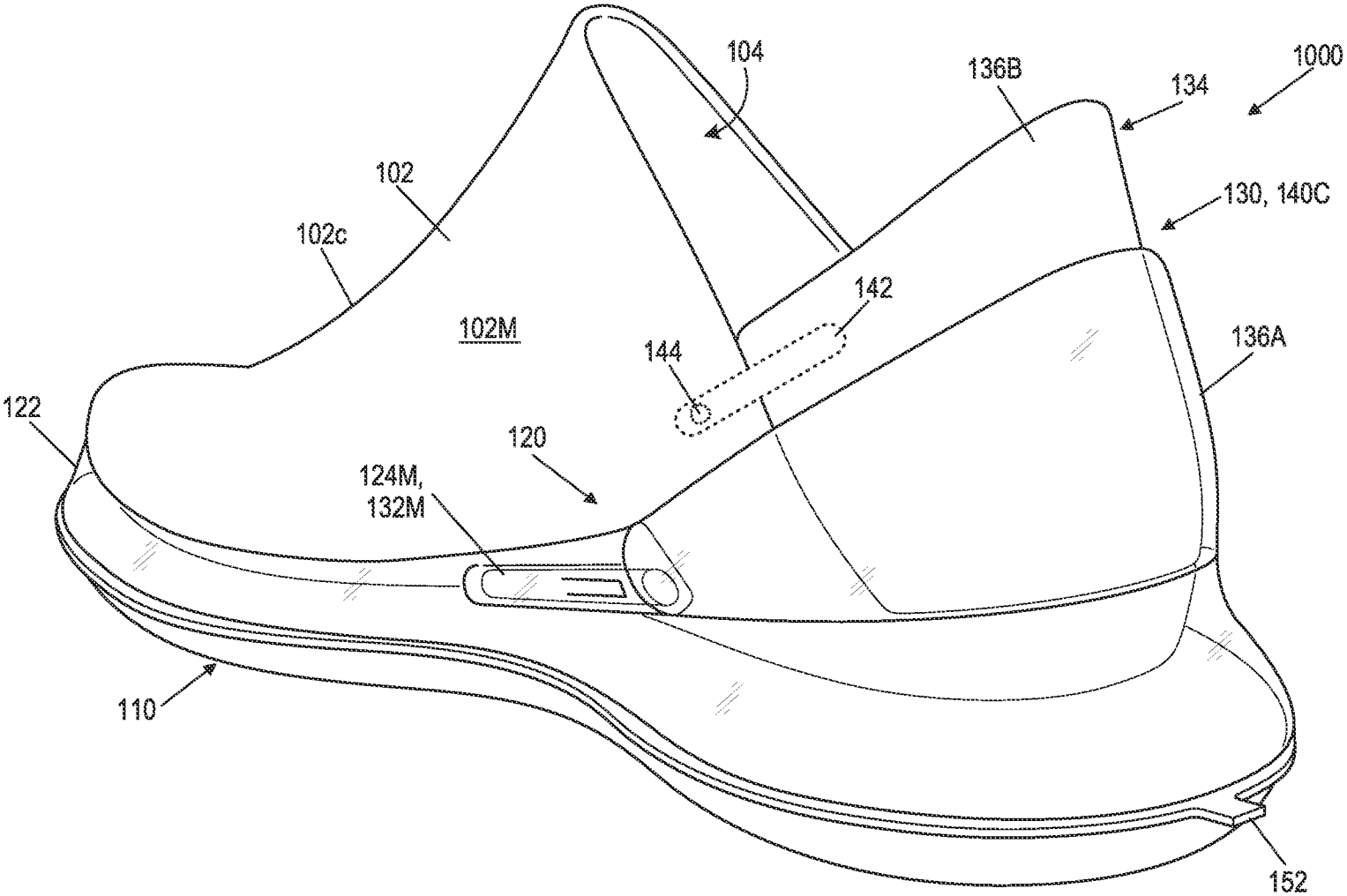
Figure 1C:
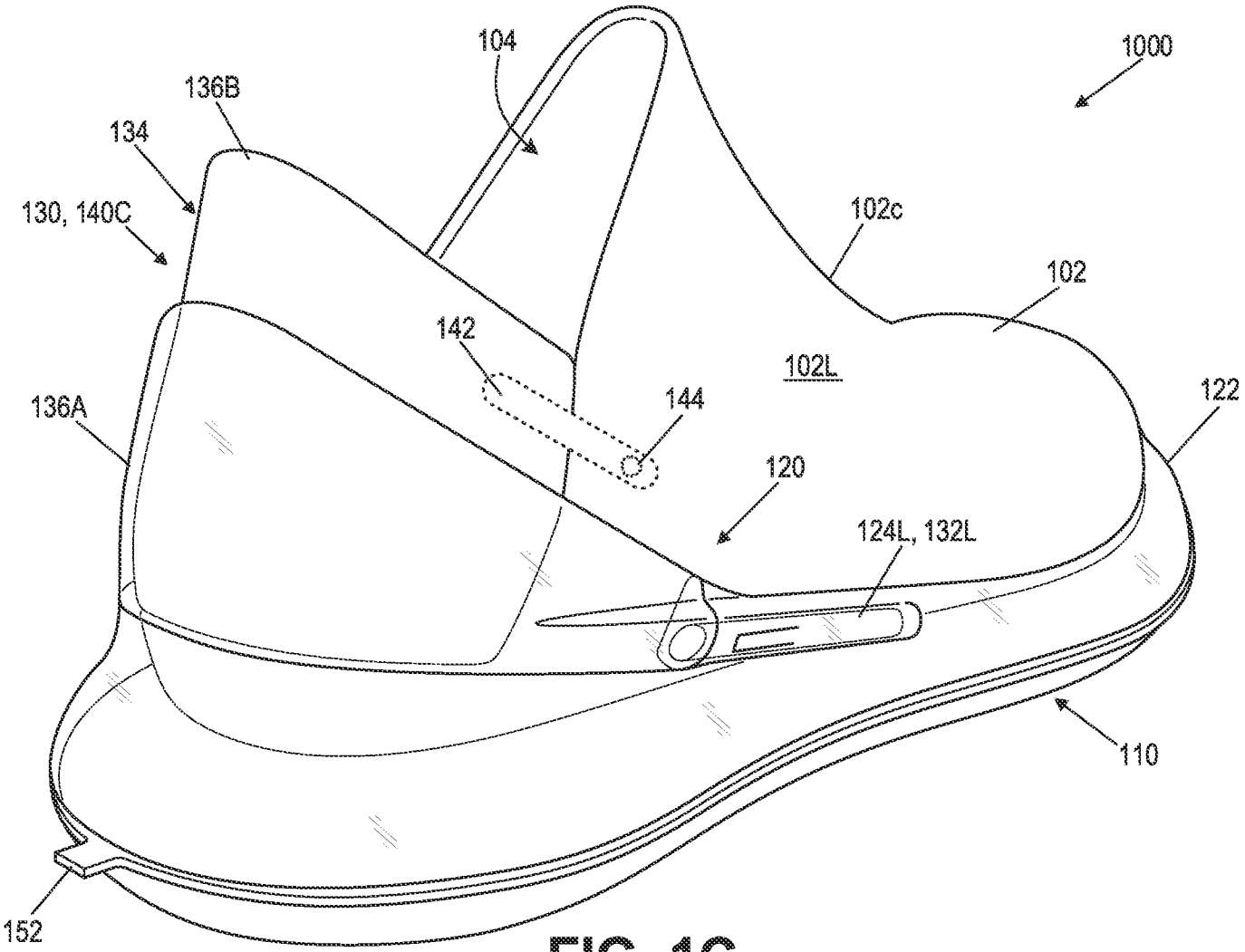
Figure 1D:
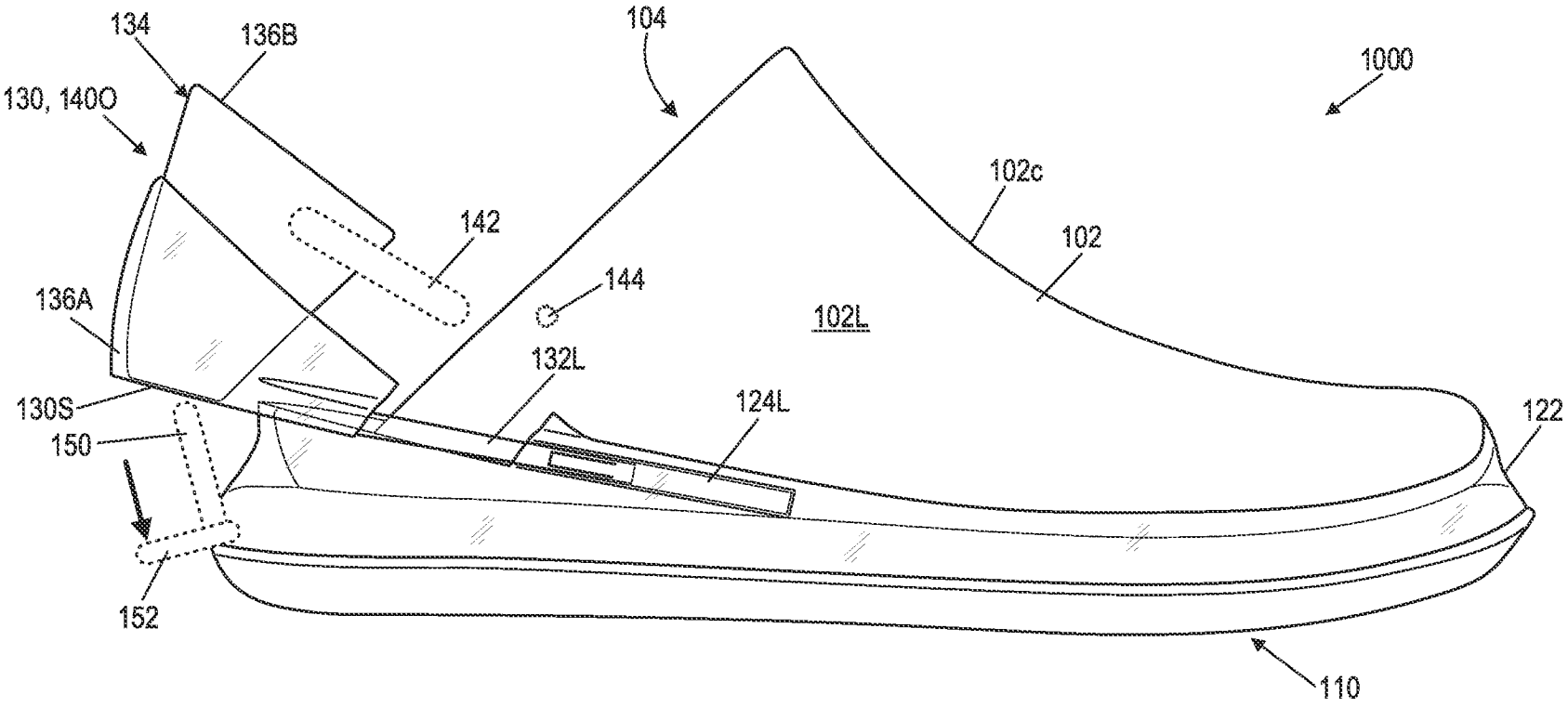
Figure 1E:
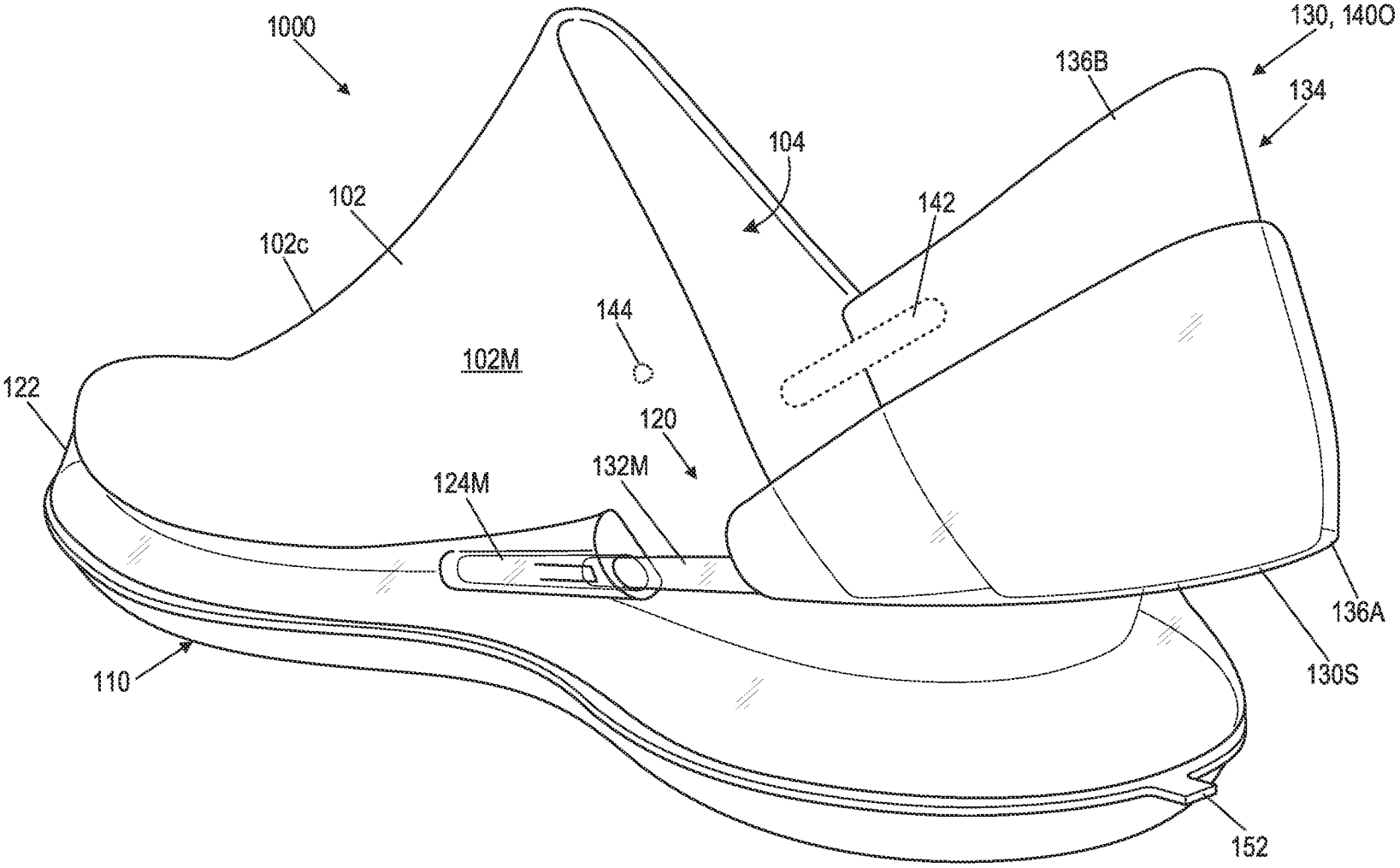
Figure 1F:
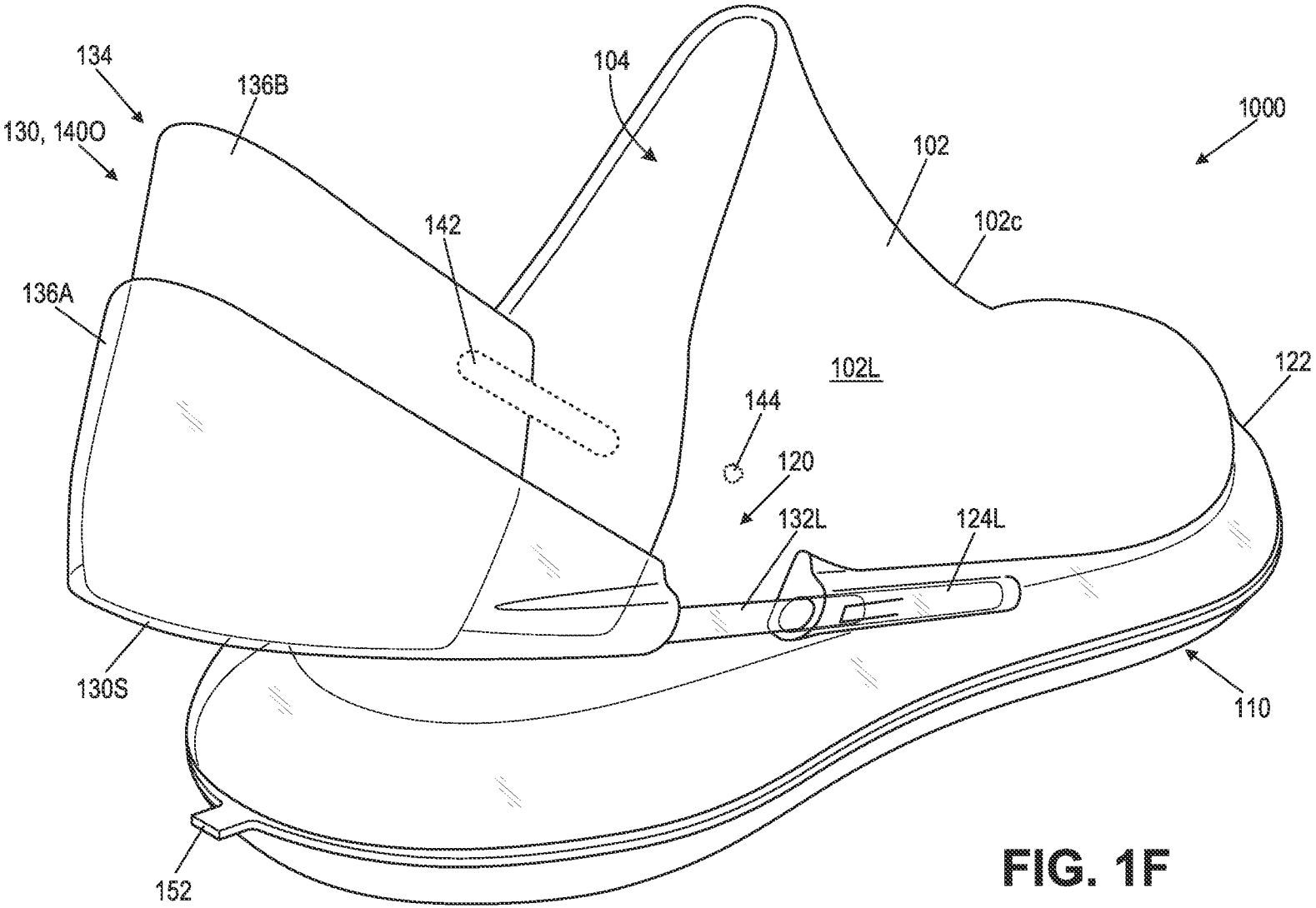
Figure 1G:
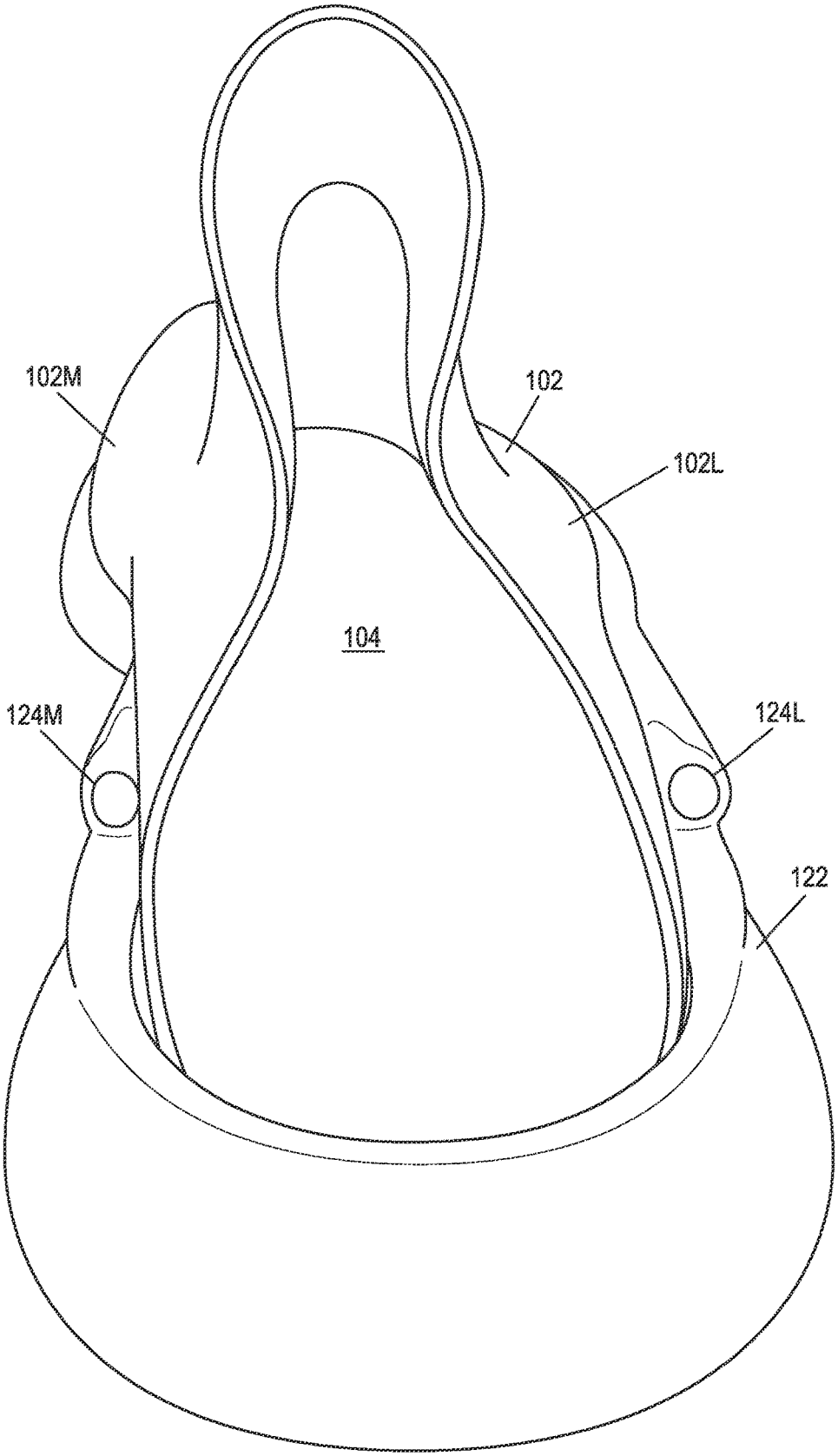
Figure 1H:
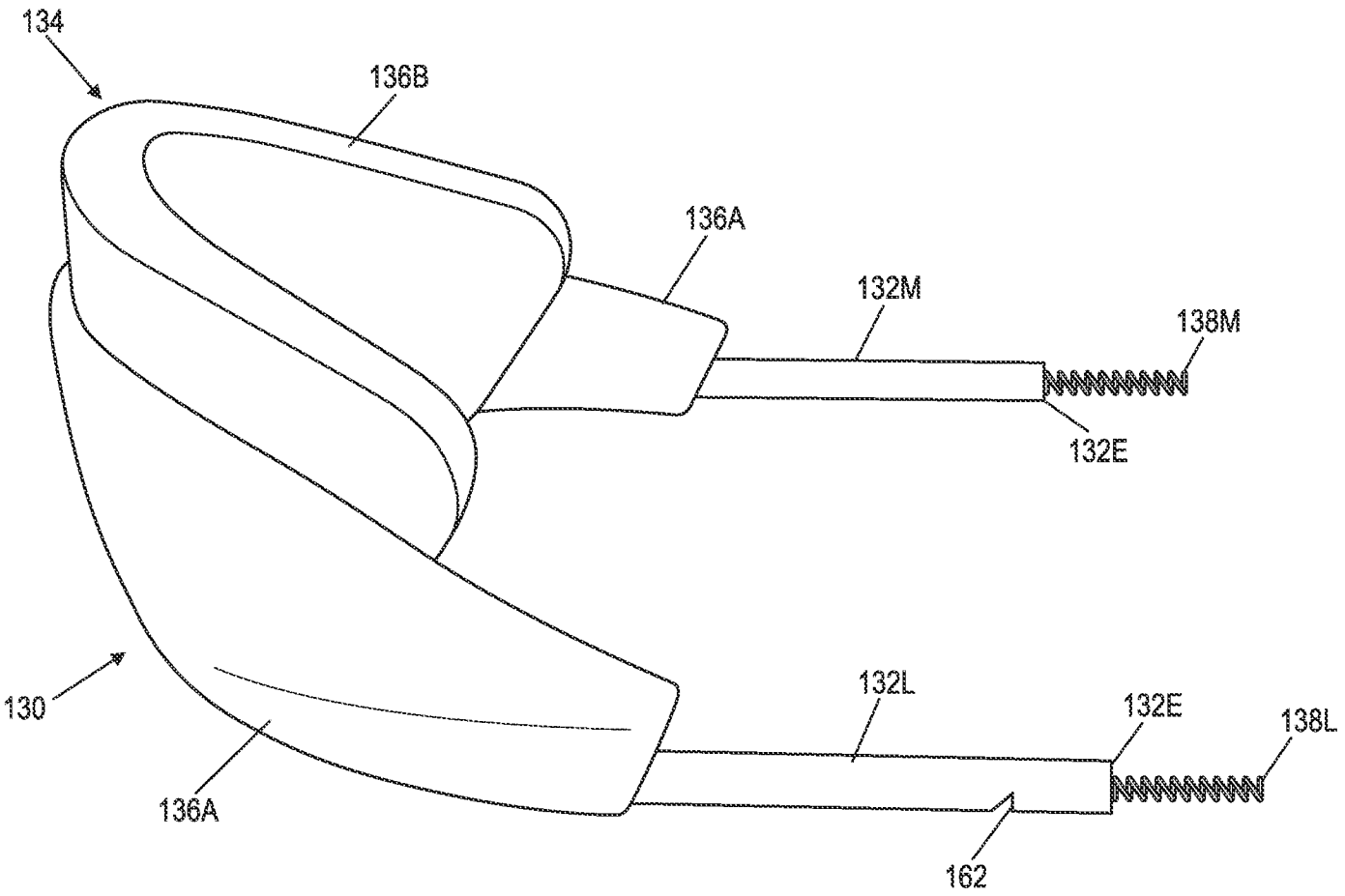
Figure 1I:
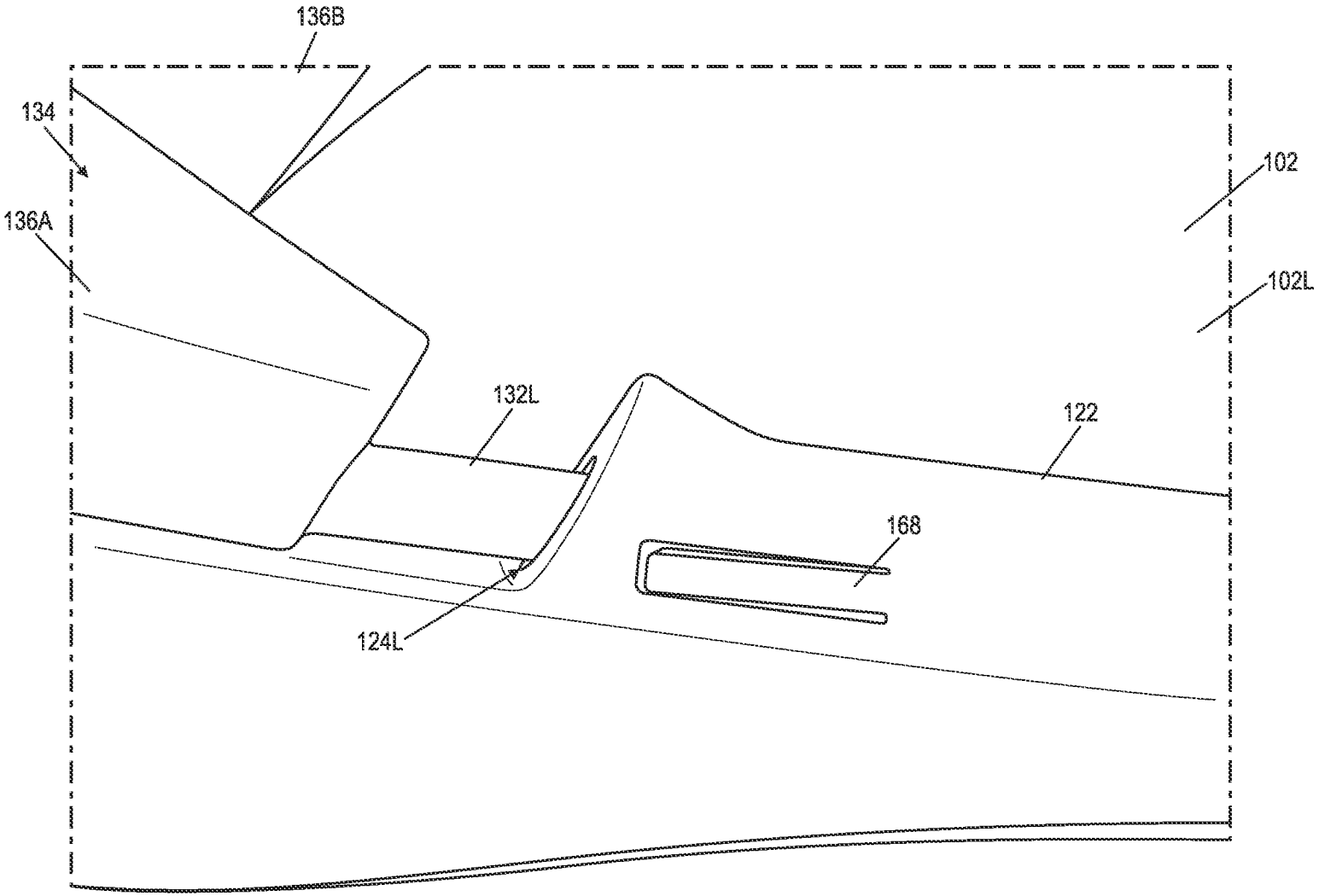
Figure 1J:
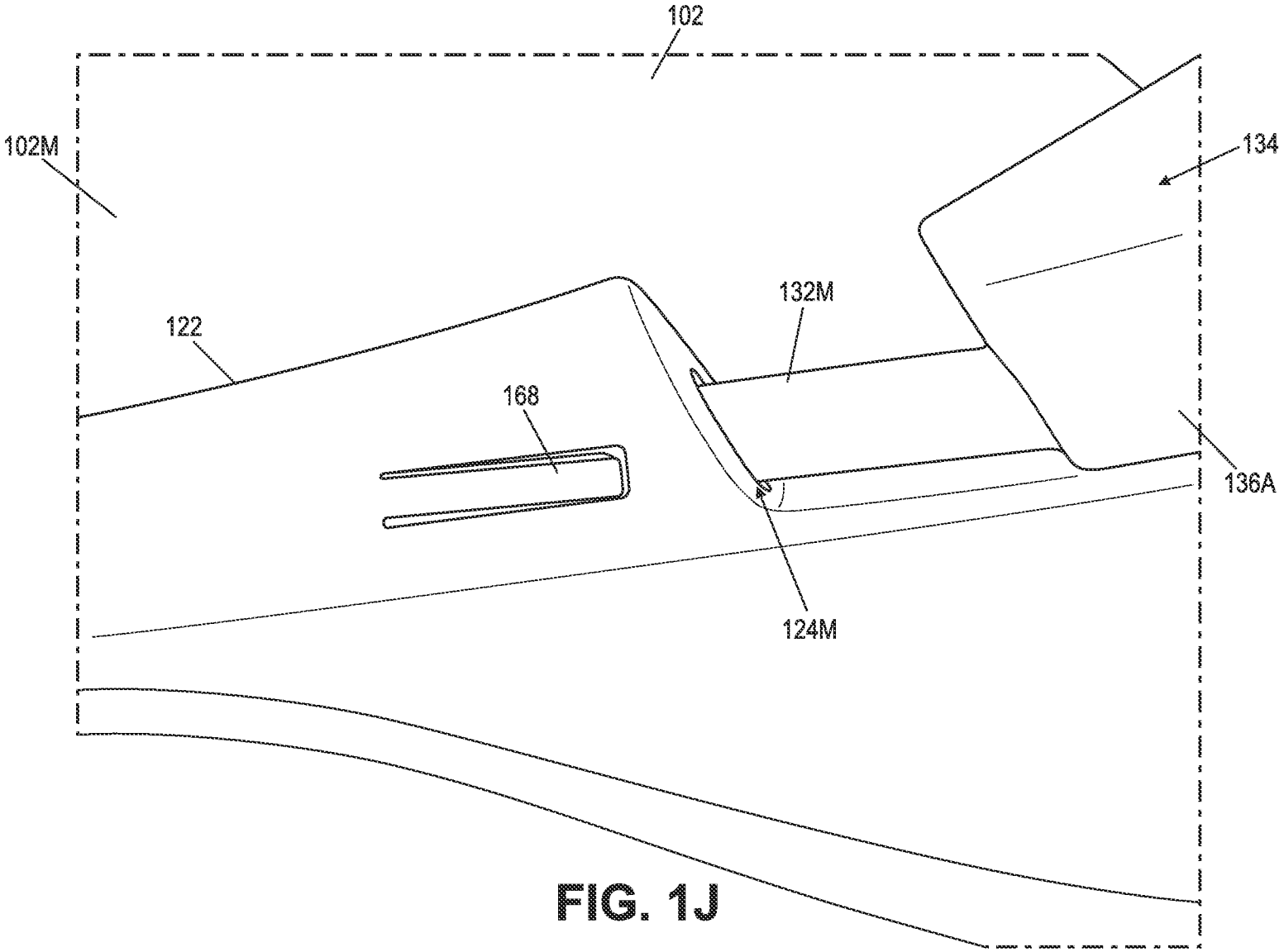
Figure 1K:
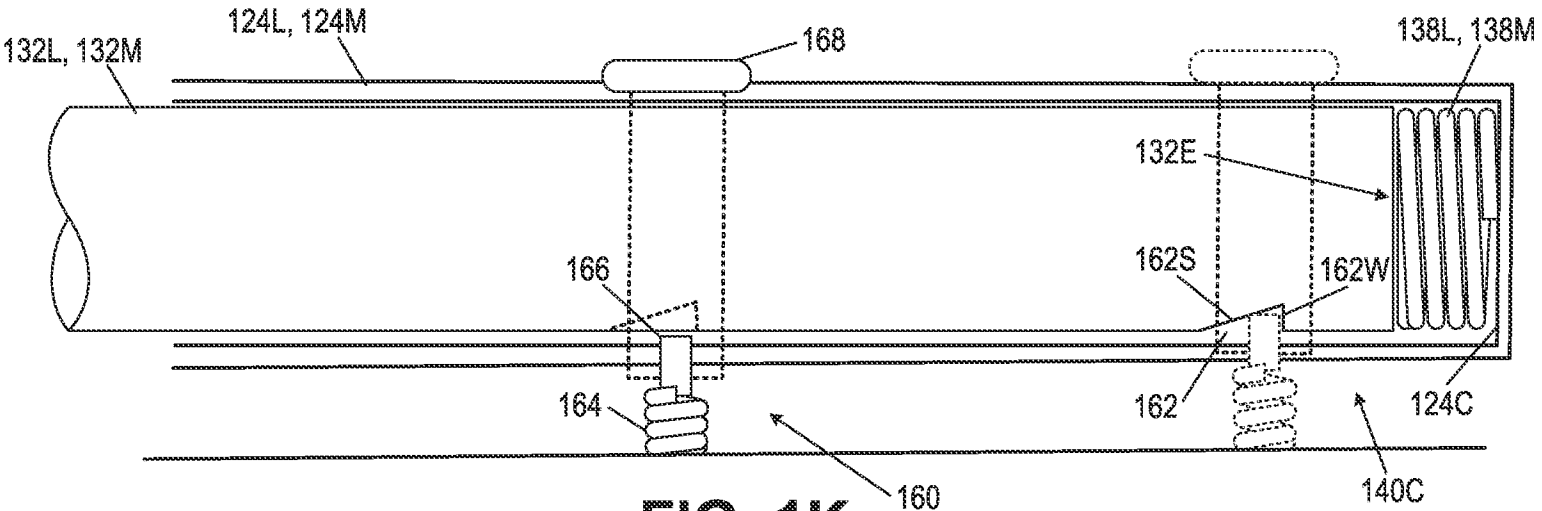
Figure 1L:
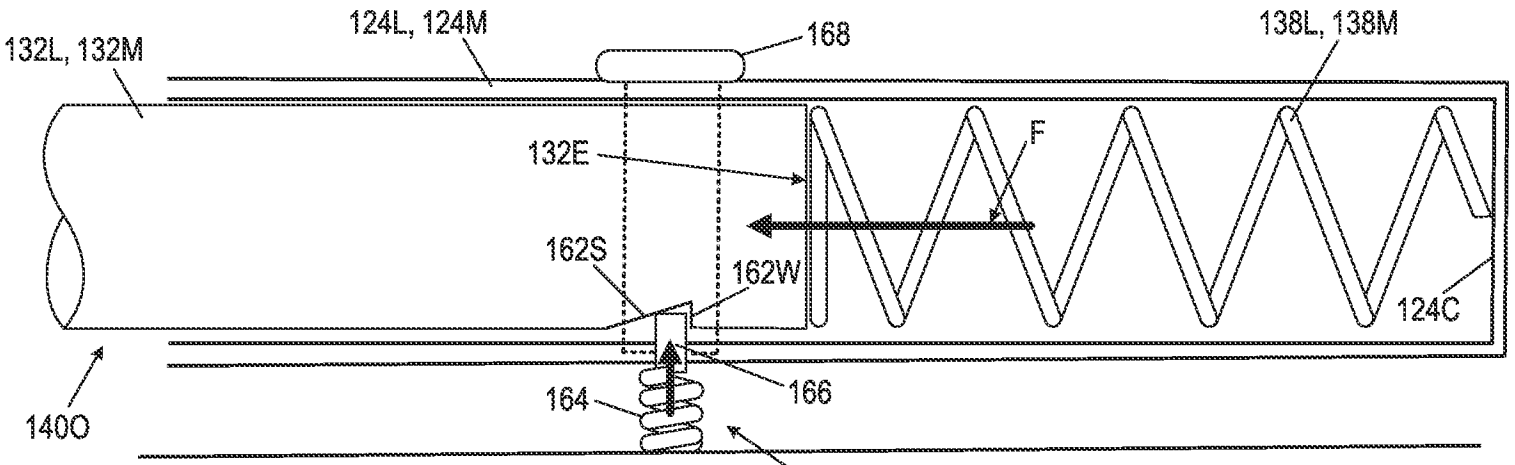
Figure 2A:
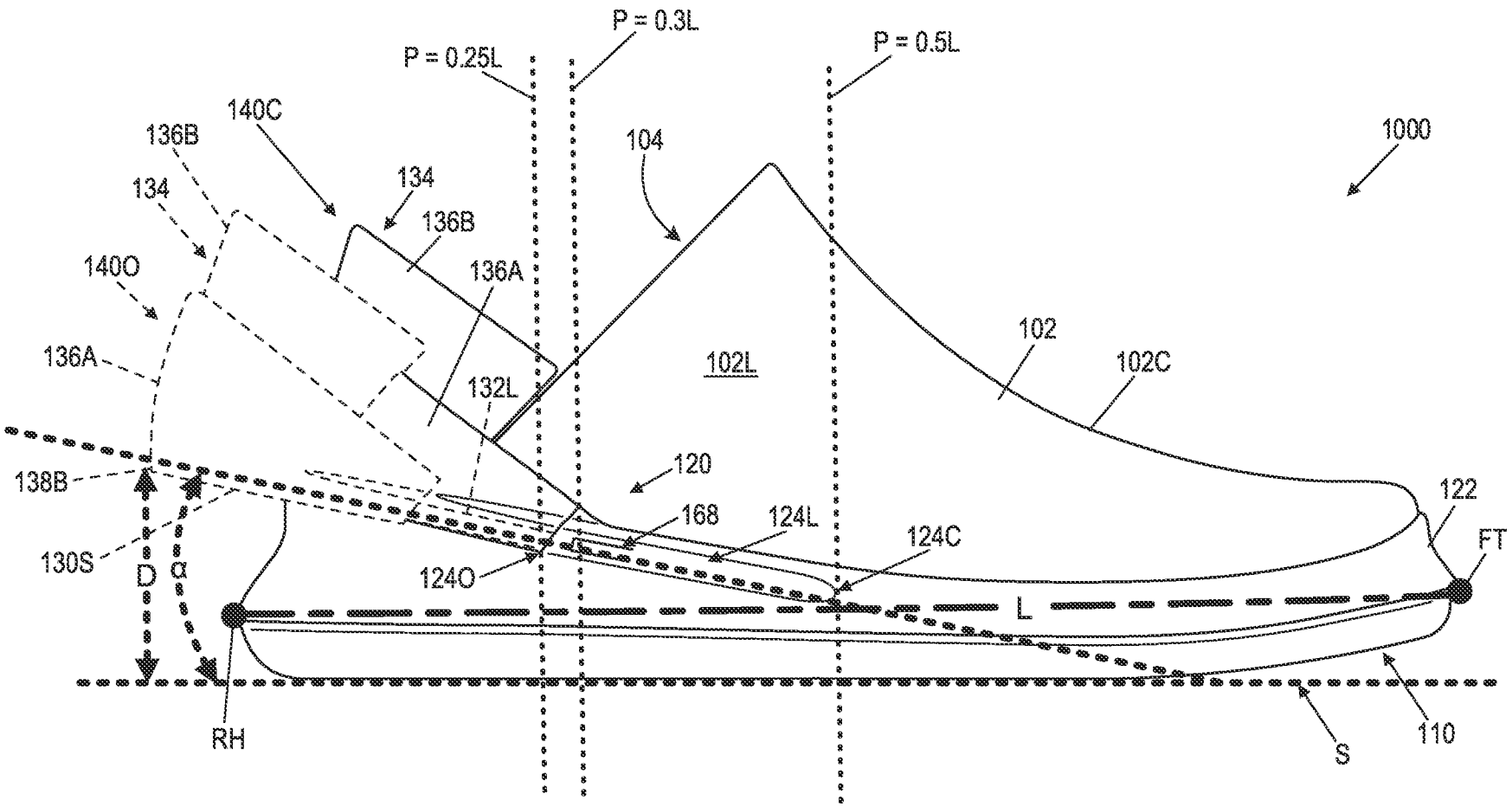
FIGS. 2A through 2N provide various views of an example article of footwear and/or components thereof in accordance with some examples and aspects of this technology.
Figure 2B:
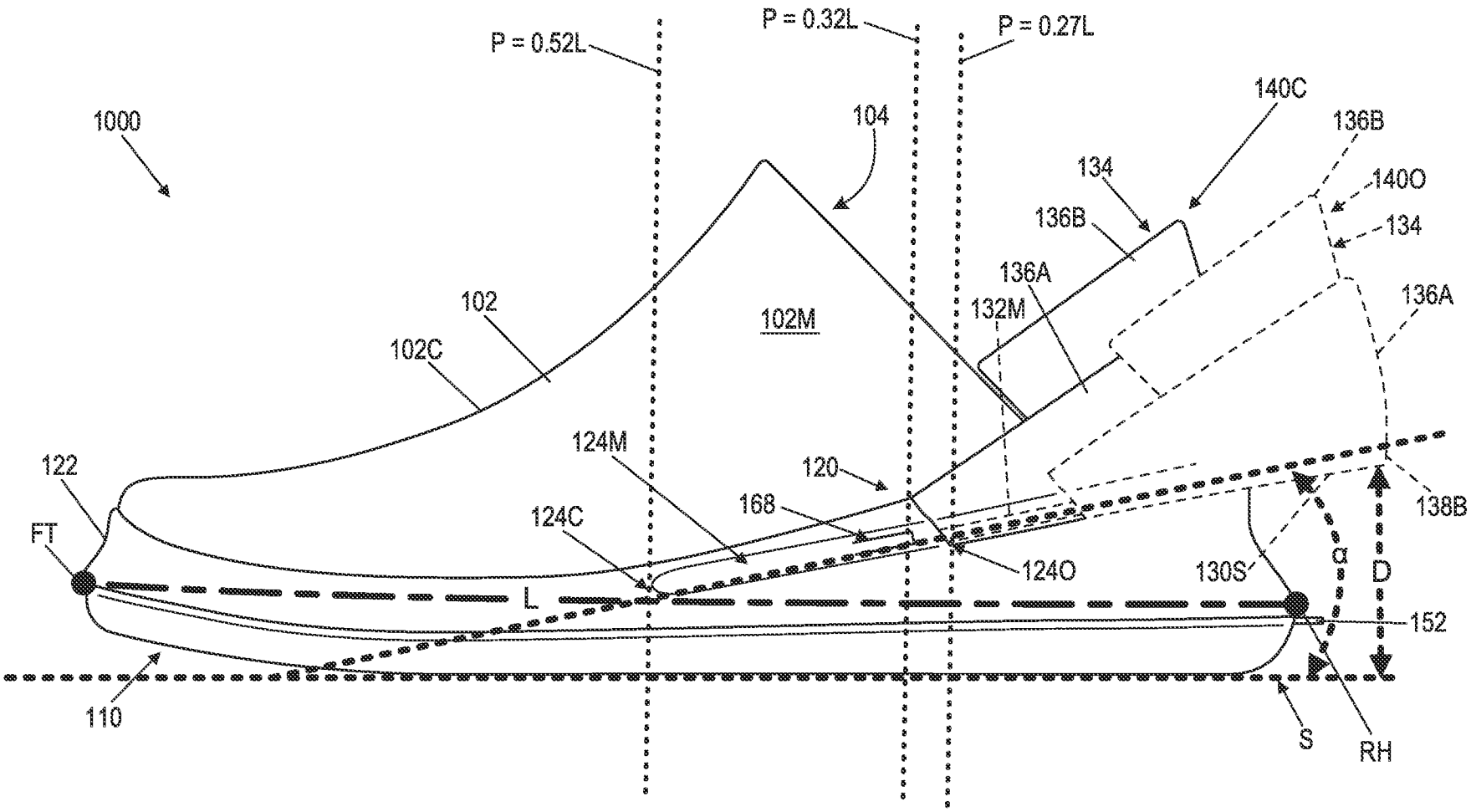
Figure 2C:
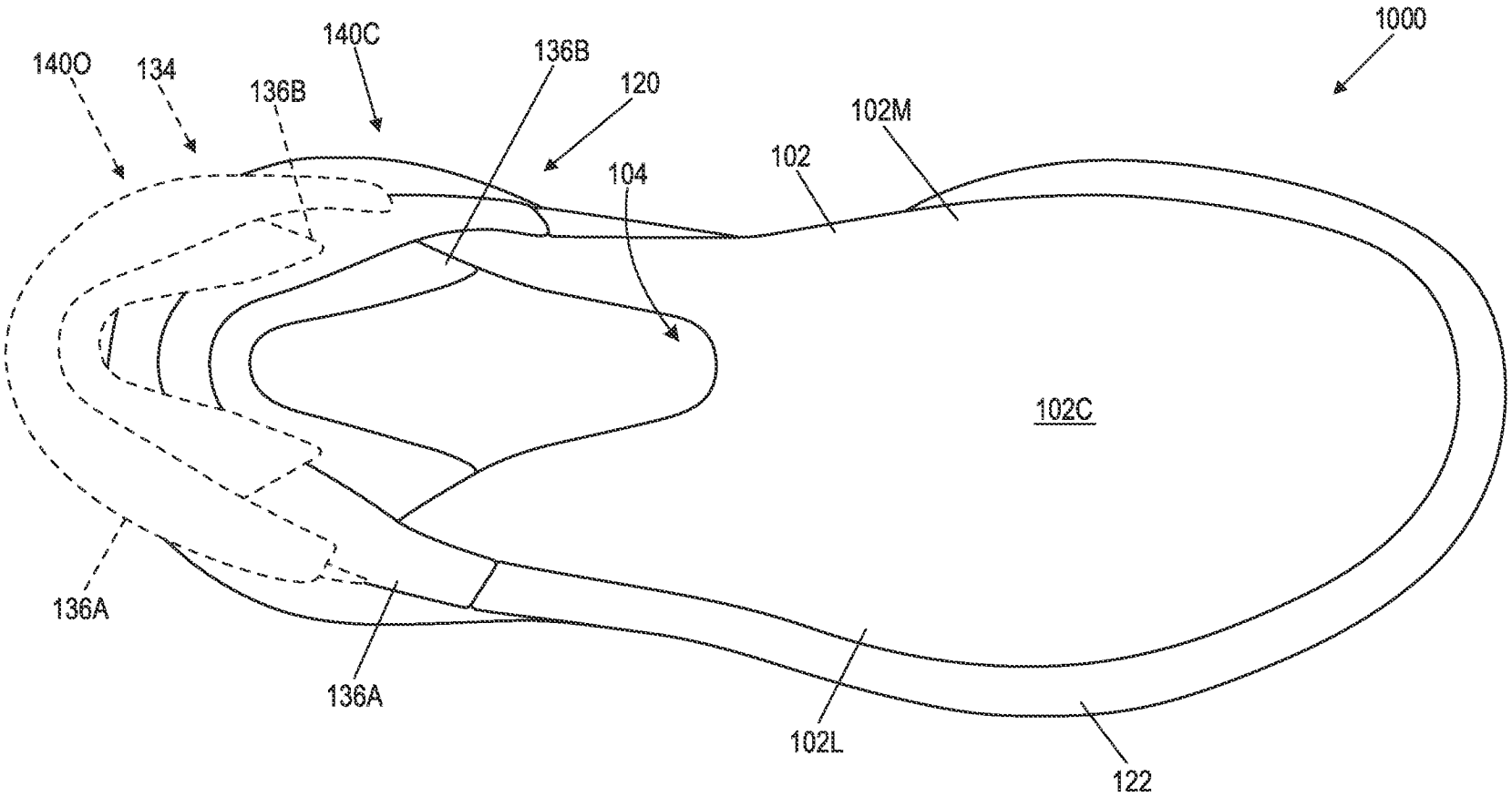
Figure 2D:
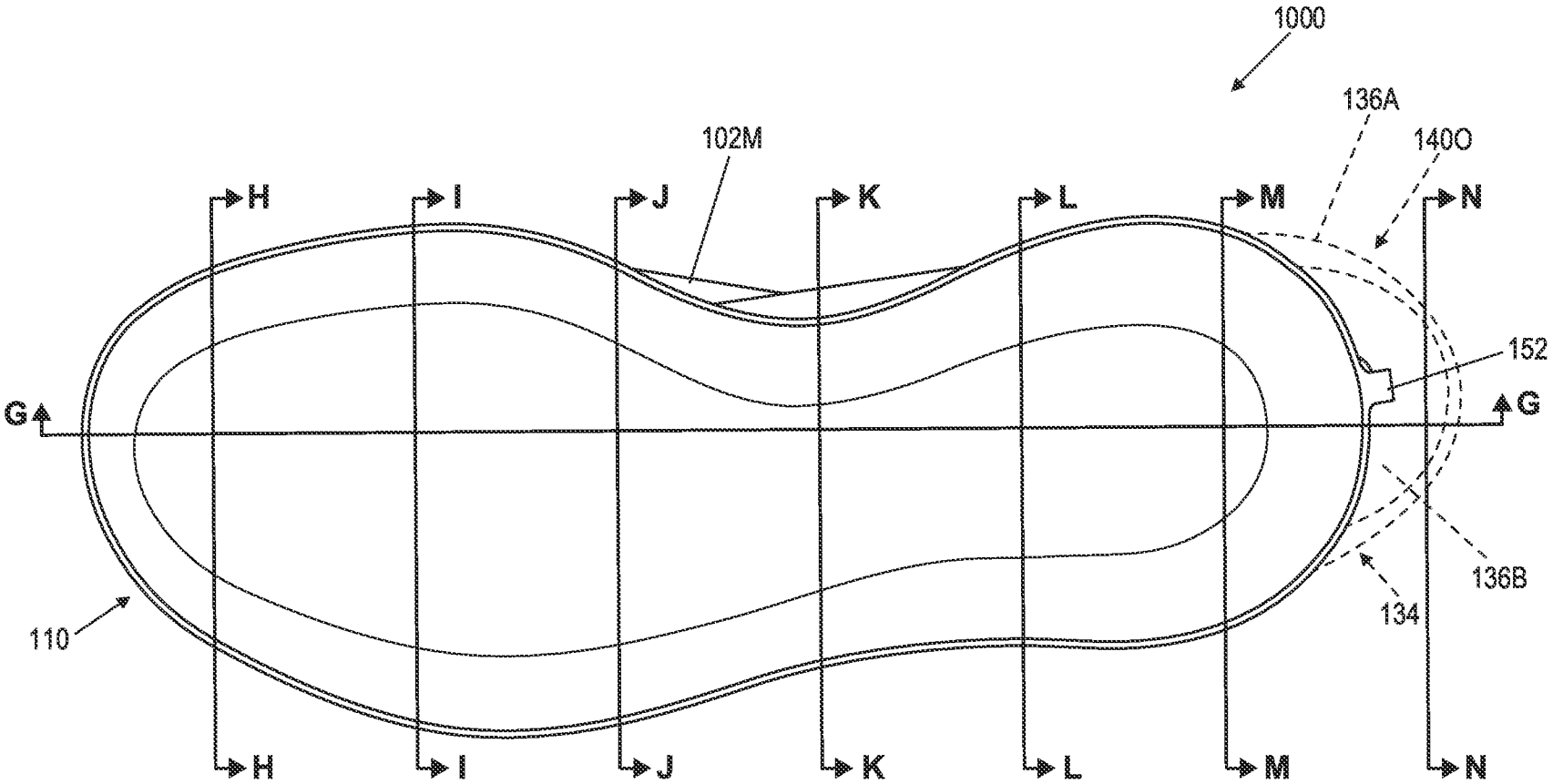
Figure 2F:
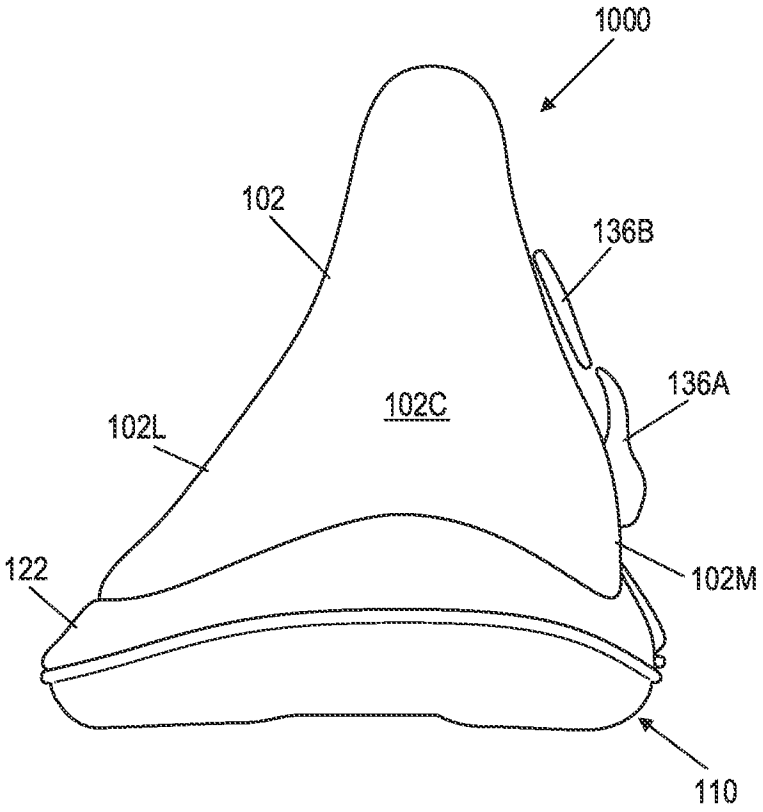
Figure 2E:
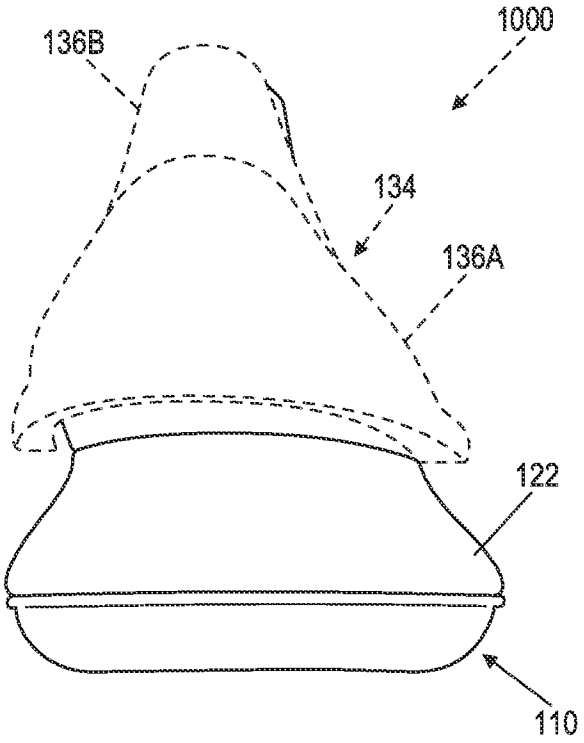
Figure 2G:
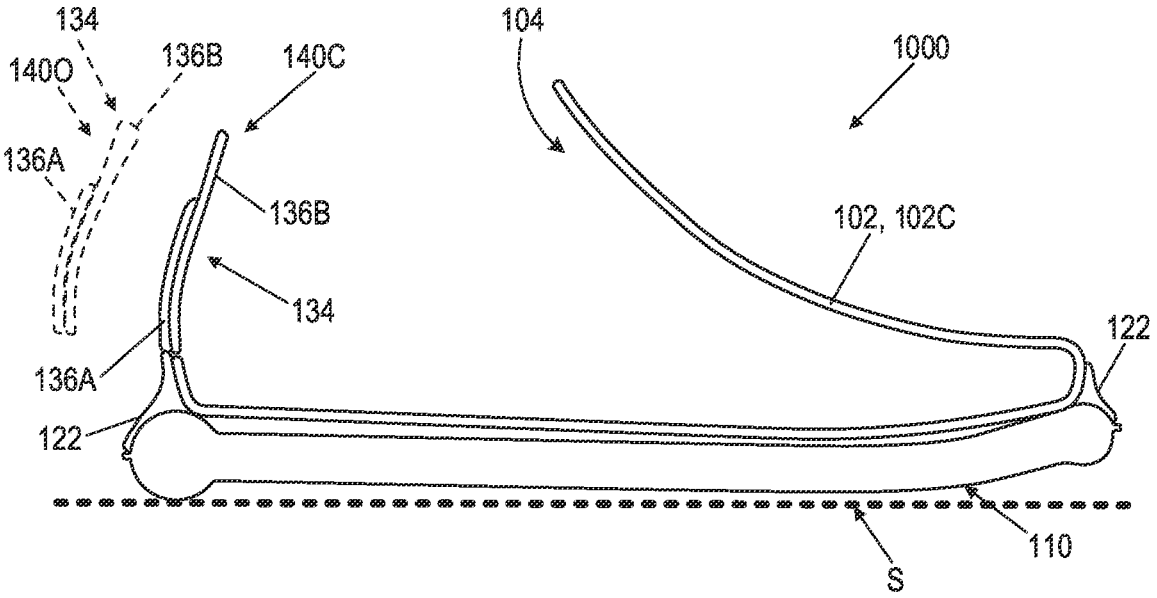
Figure 2N:
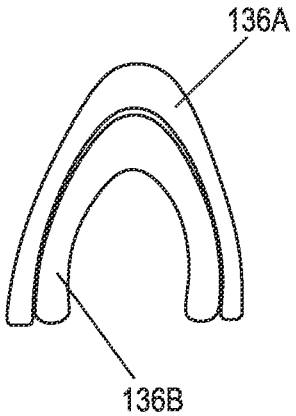
Figure 2J:
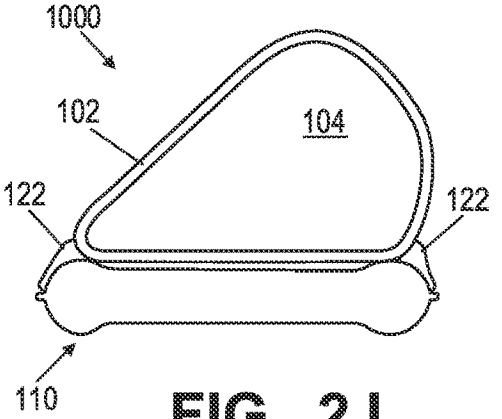
Figure 2I:
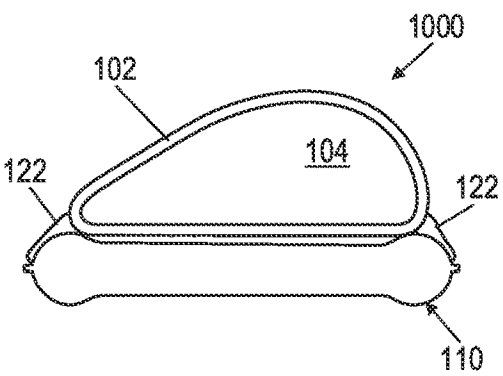
Figure 2H:
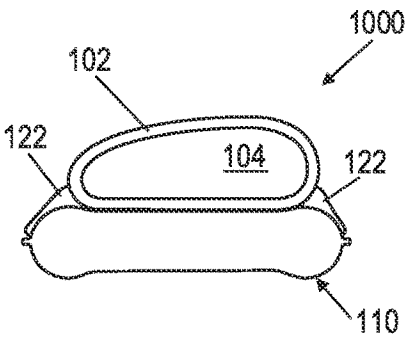
Figure 2M:
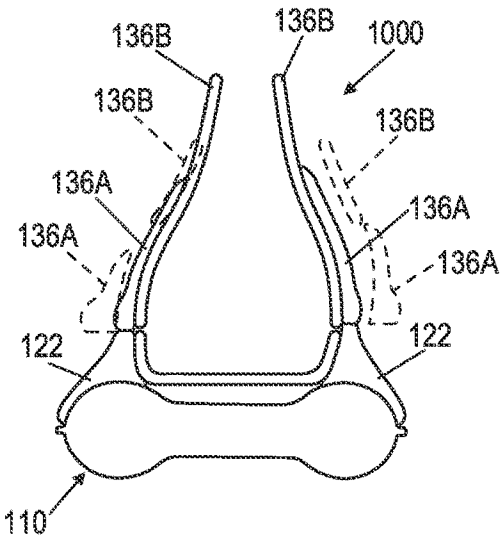
Figure 2L:
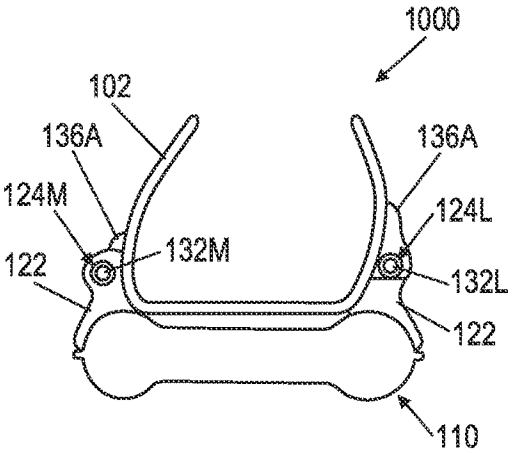
Figure 2K:
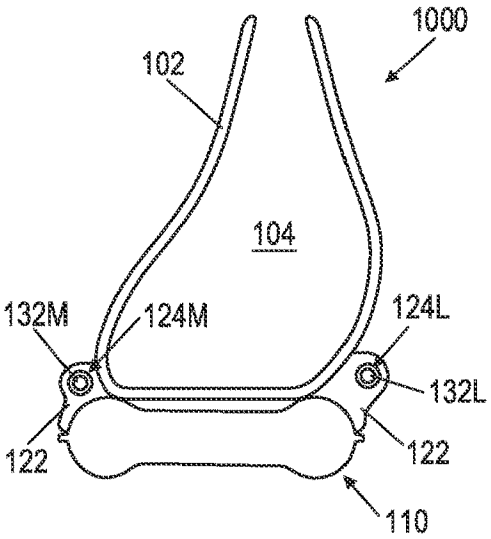
Figure 3:
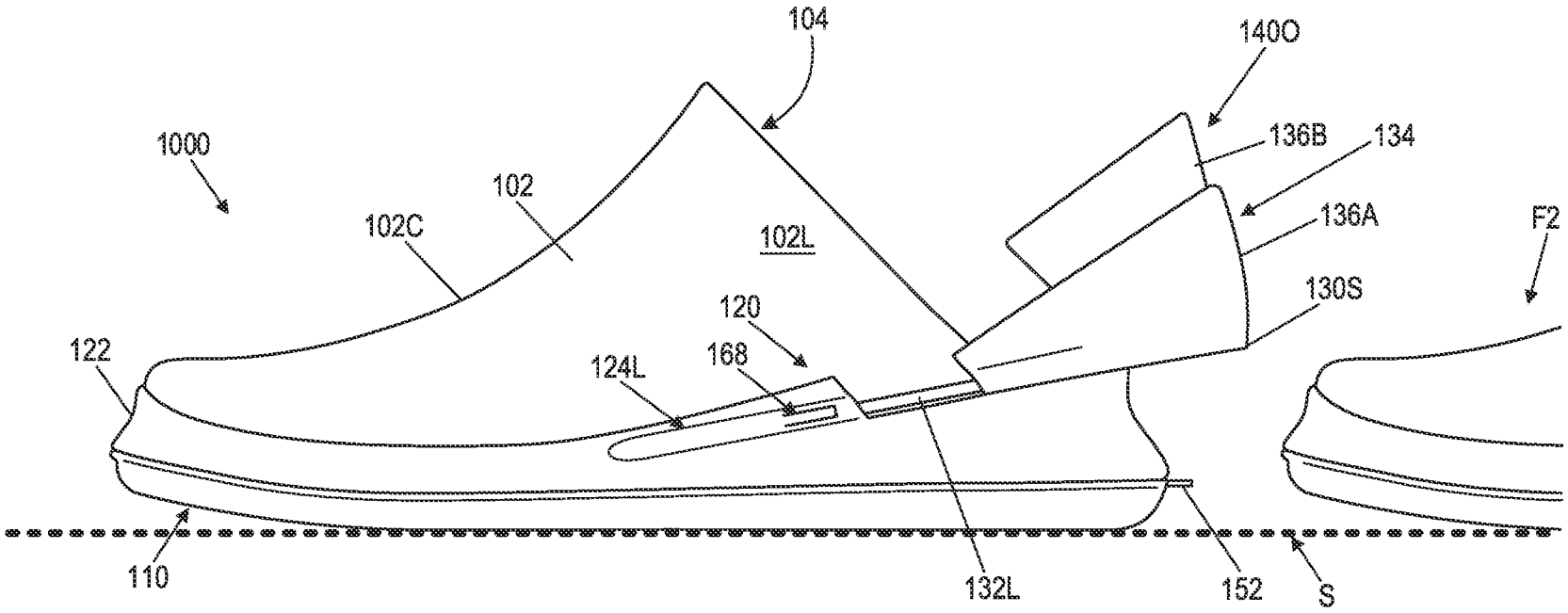
FIG. 3 provides a view showing operation of components of articles of footwear in accordance with at least some examples and aspects of this technology.
Figure 4:
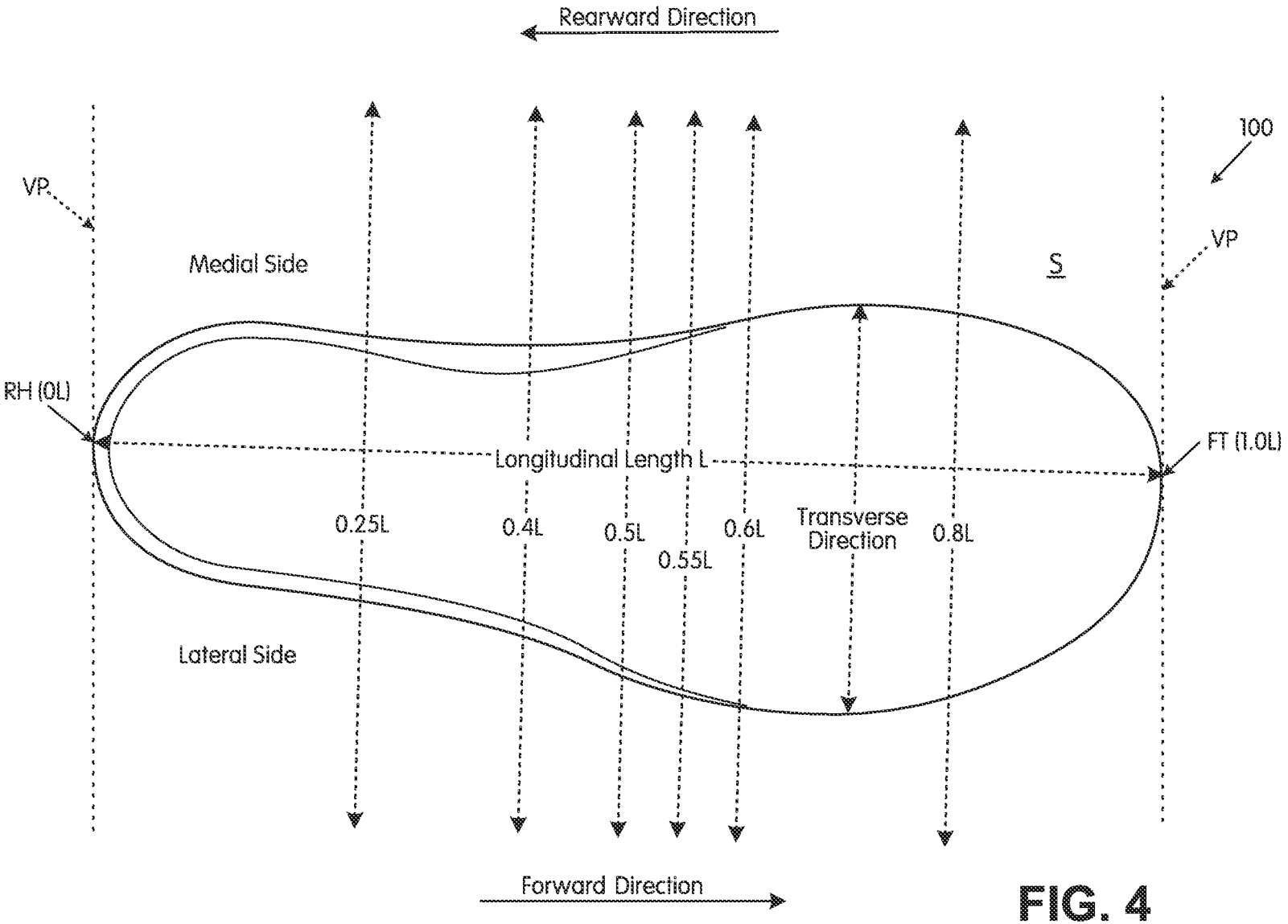
FIG. 4 is provided to help illustrate and explain background and definitional information useful for understanding certain terminology and aspects of this technology.

II. Detailed Description of Specific Example Articles of Footwear Including Aspects of this Technology FIGS. 1A-1L provide various views of example articles of footwear 1000 and/or component parts thereof in accordance with at least some examples of this technology. This example article of footwear 1000 includes an upper portion 102 formed of one or more parts, and in particular, this upper portion 102 at least partially defines a front or forward part of a foot-receiving chamber 104 for the article of footwear 1000. As shown in FIGS. 1A-1F, the upper portion 102 includes a lateral side 102L, a medial side 102M, and a central portion 102C connecting the lateral side 102L and medial side 102M (and extending across an instep area of the footwear 1000). FIGS. 2A-3 provide additional views of a similar article of footwear 1000, and the same reference numbers are used in FIGS. 2A-3 to refer to the same or similar parts as in FIGS. 1A-1L.

More specifically: FIG. 1A provides a lateral side view of an example article of footwear 1000 in a closed configuration; FIG. 1B provides a rear-medial perspective view of this same example article of footwear 1000 in the closed configuration; FIG. 1C provides a rear-lateral perspective view of this same example article of footwear 1000 in the closed configuration; FIG. 1D provides a lateral side view of this same example article of footwear 1000 in an open configuration; FIG. 1E provides a rear-medial perspective view of this same example article of footwear 1000 in the open configuration; FIG. 1F provides a rear-lateral perspective view of this same example article of footwear 1000 in the open configuration; FIG. 1G shows an example combined upper portion 102 and base component 122 of an example article of footwear 1000 with the heel engaging component 130 removed; FIG. 1H shows an example heel engaging component 130 removed from the article of footwear 1000; FIG. 1I provides a close up lateral side view of an example stop system or locking system activator 168 and the lateral side rail 132L engaging its track component 124L; FIG. 1J provides a close up medial side view of an example stop system or locking system activator 168 and the medial side rail 132M engaging its track component 124M; FIG. 1K shows example structure inside the tracks 124L, 124M in the closed configuration; FIG. 1L shows example structure inside the tracks 124L, 124M in the open and stopped configuration; FIG. 2A provides a lateral side view of an article of footwear 1000 according to some examples of this technology; FIG. 2B provides a medial side view of the article of footwear 1000 of FIG. 2A; FIG. 2C provides a top view of the article of footwear 1000 of FIG. 2A; FIG. 2D provides a bottom view of the article of footwear 1000 of FIG. 2A; FIG. 2E provides a rear view of the article of footwear 1000 of FIG. 2A; FIG. 2F provides a front view of the article of footwear 1000 of FIG. 2A; FIGS. 2G-2N provide cross sectional views taken along lines G-G, H-H, I-I, J-J, K-K, L-L, M-M, and N-N respectively shown in FIG. 2D; and FIG. 3 shows various potential operational features of the article of footwear 1000 of FIGS. 2A-2N. More detailed descriptions of these figures and these example articles of footwear 1000 follow.

The upper portion 102 may be made from any desired materials, constructions, parts, and/or number of parts without departing from this technology, including conventional materials, constructions, parts, and/or numbers of parts as are known and used in the footwear art. Further, this example article of footwear 1000 includes a sole structure 110. The sole structure 110 may include a midsole (e.g., one or more impact force attenuating components, such as one or more fluid-filled bladders, one or more polymeric foam components, one or more mechanical shock absorber structures, etc.) and/or an outsole (e.g., ground-contacting components, formed from rubber or other materials, and the sole structure further may include traction enhancing components, such as treads, cleats, etc.). The sole structure 110 (e.g., a midsole and/or outsole) may be made from any desired materials, constructions, parts, and/or number of parts without departing from this technology, including conventional materials, constructions, parts, and/or numbers of parts as are known and used in the footwear art.

If desired, the upper portion 102 and/or the sole structure 110 may include at least some portion of one or more structures to help secure the article of footwear 1000 to a wearer's foot, such as a conventional lace system, one or more straps (e.g., releasably fixed in place by buckles, buttons, hook-and-loop fasteners, or the like). One aspect of this technology, however, as described in detail below, relates to securing systems 120 for securing the footwear 1000 to a wearer's foot. These securing systems 120 allow for rear insertion of the wearer's foot into the forward part of the foot-receiving chamber 104, as will be described in more detail below. In at least some examples of this technology, the securing system 120 will completely replace conventional laces, straps, and/or other conventional footwear securing systems.

As part of this example securing system 120, this article of footwear 1000 includes a base component 122 that may be: (a) engaged with the upper portion 102, (b) integrally formed as part of the upper portion 102, (c) engaged with the sole structure 110, and/or (d) integrally formed as part of the sole structure 110 for the article of footwear 1000. In the illustrated examples, the base component 122 extends completely around the article of footwear 1000 and provides an intermediate member to which each of the upper portion 102 and the sole structure 110 is engaged. This base component 122 at least partially separates the upper portion 102 and the sole structure 110 in this example, and if desired, it may completely separate the upper portion 102 and sole structure 110. Alternatively, if desired, the base component 122 need not extend to completely separate the upper portion 102 and the sole structure 110. For example, if desired, the base component 122 could be located only in the heel and/or midfoot areas of the footwear 1000 structure, around only outer perimeter portions of the heel, midfoot, and/or forefoot areas of the footwear 1000 structure, and/or have other sizes and/or shapes consistent with its intended functions, as will be described in more detail below.

The base component 122 may be made of any desired material(s), including materials known and used in footwear construction, such as one or more of: plastic materials, non-foam plastic materials, thermoplastic materials, thermosetting materials, polyether block amide materials, fiber reinforced plastic materials, and/or metal or metal alloy materials. In some more specific examples, the base component 122 may be made from a rigid material, such as a thermoplastic polyurethane material, a polyether block amide material (e.g., PEBAX®, available from Arkema), or the like. The base component 122 may be constructed of a material that is sufficiently rigid to support the actions and functions described in more detail below (e.g., the track/rail features), but it may have some flexibility and/or resiliency (e.g., under forces from the wearer's foot) to not adversely affect comfort and/or performance for the wearer (e.g., flex somewhat as a wearer lands a step or jump and then return to its original shape and/or configuration, provide desired support characteristics, etc.).

The base component 122 of this illustrated example supports and/or defines at least one track component for the securing system 120. In the illustrated example, the base component 122 supports and/or defines: (a) a lateral side track 124L, e.g., that extends along the lateral side 102L of the upper portion 102 and (b) a medial side track 124M, e.g., that extends along the medial side 102M of the upper portion 102. The lateral side track 124L and the medial side track 124M of this illustrated example constitute blind hole channels defined in the material of the base component 122 along the side heel and/or midfoot areas of the footwear 1000 structure. Additionally or alternatively, these channels could be at least partially formed (and in some example structures—completely formed) in the upper portion 102 and/or the sole structure 110. Either or both tracks 124L, 124M also could be open ended channels (and the rail(s) 132L, 132M could extend outward through the open end (e.g., at least in the closed configuration)), have other shapes, etc.

These lateral side track 124L and medial side track 124M channels may extend any desired longitudinal extent of the article of footwear 1000. In the illustrated example, as shown in FIGS. 2A and 2B, the channels extend from their open ends 124O to their closed ends 124C. The open ends 124O may be located forward of a rearmost heel location RH of the footwear 1000 and/or sole 110 structure (with the footwear 1000 in the closed configuration) between planes perpendicular to the longitudinal direction located at P=0.15L and P=0.5L, and in some examples, between planes perpendicular to the longitudinal direction located at P=0.18L and P=0.40L, or even between planes perpendicular to the longitudinal direction located at P=0.20L and P=0.32L. The lateral open end 124O begins at a perpendicular plane located at P=0.25L in this illustrated example (FIG. 2A), and the medial open end 124O begins at a perpendicular plane located at P=0.27L in this illustrated example (FIG. 2B). The closed ends 124C may be located forward of a rearmost heel location RH of the footwear 1000 and/or sole 110 structure (with the footwear 1000 in the closed configuration), and forward of their respective open ends 124O, e.g., between planes perpendicular to the longitudinal direction located at P=0.3L and P=0.65L, and in some examples, between planes perpendicular to the longitudinal direction located at P=0.35L and P=0.6L, or even between planes perpendicular to the longitudinal direction located at P=0.40L and P=0.55L. The lateral closed end 124C is located at P=0.5L in this illustrated example (FIG. 2A), and the medial closed end 124C is located at P=0.52L in this illustrated example (FIG. 2B).

The securing system 120 of this example further includes a heel engaging component 130. The heel engaging component 130 moves with respect to the upper portion 102 (and the sole structure 110) via the track component (e.g., lateral side track 124L and medial side track 124M) between a closed configuration 140C (as shown in FIGS. 1A-1C, e.g., when engaged with a wearer's foot) and an open configuration 140O (as shown in FIGS. 1D-1F, e.g., in a foot insertion and/or removal configuration). FIGS. 2A-2G and 3 show the heel engaging components of the securing system 120 in both the closed configuration 140C (solid lines) and the open configuration 140O (broken lines) for comparison purposes. One skilled in the art will understand, however, that the article of footwear 1000 and the heel engaging component 130 are not simultaneously in the closed configuration 140C and the open configuration 140O, but rather are switchable between these configurations as shown in FIGS. 1A-1F. The sole structure 110 provides a ground-contacting surface for the article of footwear 1000 and may be engaged with at least one of the upper portion 102, the base component 122 (which may include one or more track components (e.g., 124L, 124M)), and/or the heel engaging component 130. Alternatively, if desired, one or both of track components 124L and/or 124M may be formed as part of the sole structure 110 (e.g., part of a midsole and/or outsole component).

As evident from a comparison of FIGS. 1A-1C with FIGS. 1D-1F and/or from FIGS. 2A, 2B, 2G, and 3, in this footwear 1000 structure, with the footwear 1000 supported in an upright position on the ground-contacting surface of the sole structure 110 on a horizontal support surface S, the track component (e.g., lateral side track 124L and medial side track 124M) are configured to support movement of the heel engaging component 130 upward and rearward when changing from the closed configuration 140C to the open configuration 140O. This action moves the heel engaging component 130 rearward and away from the forward portion of the upper portion 102: (a) and rearward and away from the wearer's heel to allow the wearer to remove his/her foot from the interior chamber 104 of the upper portion 102 and/or (b) to open up the footwear 1000 to allow the wearer to insert his/her foot into the interior chamber 104 of the upper portion 102.

Additional features of the heel engaging component 130 in accordance with this illustrated example now will be described. Turning also to FIGS. 1G-1J, the heel engaging component 130 of this example includes, as one piece or multiple pieces: (a) a lateral rail 132L that is movably engaged (e.g., slidable) with respect to the lateral side track 124L, (b) a medial rail 132M that is movably engaged (e.g., slidable) with respect to the medial side track 124M, and (c) a rear component 134 extending between the lateral rail 132L and the medial rail 132M (around a rear heel area of the footwear 1000). The lateral rail 132L moves with respect to the lateral side track 124L and the medial rail 132M moves with respect to the medial side track 124M to move the heel engaging component 130 between the closed configuration 140C and the open configuration 140O. The rails 132L and 132M and/or the rear component 134 may be made at least in part from any desired materials, including any one or more of the materials described above for the construction of base component 122.

FIGS. 1A-1F, 1J, 2A-2G, 2M, 2N, and 3 show that the heel engaging component 130 of this example, and particularly the rear component 134 thereof, includes a multi-part structure. An outer part 136A may form a heel counter type structure, e.g., for supporting the wearer's heel. This outer part 136A may be made from a relatively rigid material, such as one or more of the materials described above for the construction of base component 122. An inner part 136B also may be provided that more directly engages the wearer's heel. This inner part 136B may be made from a comfort enhancing material (e.g., soft materials, polymeric foam, fabric, textile, and the like). The outer part 136A may be harder and/or more rigid than the inner part 136B.

FIGS. 2A and 2B further illustrate that, in this example, the forwardmost extents of the rear component 134 of the heel engaging component 130 (e.g., the forwardmost point of outer parts 136A not including the rails 132L, 132M) are located rearward of a plane perpendicular to the longitudinal direction located at P=0.45L, and in some examples, rearward of a plane perpendicular to the longitudinal direction located at P=0.4L or even rearward of a plane perpendicular to the longitudinal direction located at P=0.35L. In some examples of this technology, the forwardmost extents of the rear component 134 of the heel engaging component 130 (e.g., the forwardmost point of outer parts 136A not including the rails 132L, 132M) may be located between planes perpendicular to the longitudinal direction located at P=0.1L and P=0.45L, and in some examples, between planes perpendicular to the longitudinal direction located at P=0.15L and P=0.42L, or even between planes perpendicular to the longitudinal direction located at P=0.25L and P=0.4L. In the example of FIGS. 2A and 2B, the forwardmost points of outer part 136A are located at about P=0.3L on the lateral side (FIG. 2A) and at about P=0.32L on the medial side (FIG. 2B). All of these parallel plane locations are taken with the heel engaging component 130 and/or the securing system 120 in the closed configuration.

In at least some examples of this technology, the securing system 120 will include a biasing system that imposes forces on the heel engaging component 130 in a direction toward the open configuration 140O (e.g., in a direction to move the heel engaging component 130 from the closed configuration 140C to/toward the open configuration 140O). In the specific example illustrated in FIGS. 1H, 1K, and 1L, the free ends 132E of each of the lateral side rail 132L and the medial side rail 132M engage (and may be attached to) a spring 138L, 138M, respectively. When the heel engaging component 130 is in the closed configuration 140C, the springs 138L and 138M will be compressed between (a) the free ends 132E of the lateral side rail 132L and the medial side rail 132M and (b) the closed ends 124C of the blind holes of lateral side track 124L and medial side track 124M, respectively. See FIG. 1K. The springs 138L, 138M may be engaged with their respective rail 132L, 132M, fixed at the closed end 124C of their respective side tracks 124L, 124M, and/or unfixed within the blind holes of the lateral side track 124L and medial side track 124M, respectively. Also, any desired type of spring structure may be used without departing from the technology, such as a coil spring (as shown), a leaf spring, a torsion spring, a flat spring, a resilient member (e.g., a compressible resilient member made from one or more of: (a) a foam material, (b) a rigid but flexible material (such as plastic materials, non-foam plastic materials, thermoplastic materials, thermosetting materials, polyether block amide materials, fiber reinforced plastic materials etc.)), etc.

The heel engaging component 130 may be locked at the closed configuration 140C (with the springs 138L, 138M compressed as shown in FIG. 1K) to maintain the heel engaging component 130 in a "locked" configuration and in the closed configuration 140C. When the lock is released, the biasing force applied by the springs 138L, 138M will push the rails 132L, 132M (and thus the heel engaging component 130) outward with respect to the tracks 124L, 124M (see FIG. 1L), thereby moving the heel engaging component 130 (and the overall article of footwear 1000) toward/to the open configuration 140O.

Any desired structure may be used to releasably lock the heel engaging component 130 in the closed configuration 140C. For example, if desired, one or more straps 142 (shown in broken lines in FIGS. 1A-1F) may extend: (a) from the movable heel engaging component 130 (e.g., outer part 136A and/or inner part 136B) to (b) the upper portion 102 and/or a portion of the base component 122. The strap(s) 142 could be releasably secured by a fastener 144, such as a buckle, snap, hook-and-loop fastener, button, zipper, magnet, or the like, to change between a "locked" (closed) configuration and an "unlocked" (open) configuration.

In addition or as an alternative to securing straps 142/fasteners 144 of the types described above, if desired, the locking system may include one or more retaining parts 150, e.g., that engage the heel engaging component 130 to hold the heel engaging component 130 in the closed configuration 140C. See FIGS. 1A and 1D (broken lines). While other structures are possible, the one or more retaining parts 150 may bear against the exterior and/or rear surface of the outer part 136A or another part of the heel engaging component 130, may extend into a recess or channel defined in the bottom surface of the heel engaging component 130 (e.g., in the outer part 136A) and/or the base 122 and/or the sole structure 110, and/or may otherwise engage the heel engaging component 130 to hold the heel engaging component 130 in the closed configuration 140C, e.g., against the biasing force of the biasing system (e.g., springs 138L, 138M). This illustrated example locking system (FIGS. 1A and 1D) further includes a release mechanism 152, which may be located at a rear heel area of the article of footwear 1000 (e.g., engaged with one or more of the base component 122, the sole structure 110, and/or other footwear component). The release mechanism 152 and the retaining part(s) 150 may be configured and arranged such that downward force F on the release mechanism 152 will rotate and/or slide the retaining part(s) 150 outward and/or downward to disengage the retaining part(s) 150 from the heel engaging component 130. Note FIGS. 1A and 1D. This action, together with the biasing force from springs 138L, 138M (or other biasing system, when present), will allow the heel engaging component 130 to change from the closed configuration 140C to the open configuration 140O. The release mechanism 152 may be spring loaded or biased toward the upward, locked condition so that the retaining part(s) 150 will stay in the locked configuration in the absence of external forces (e.g., on the release mechanism 152 applied by the wearer and/or by a bottom of the heel engaging component 130 in the open configuration). As shown in FIGS. 1D-1F, 2A, 2B, and 3, with the article of footwear 1000 supported in an upright position on the ground-contacting surface of the sole structure 110 on a horizontal support surface S and in the open configuration 140O, the track component(s) (e.g., the lateral track 124L and the medial track 124M) and/or the rail(s) (e.g., the lateral rail 132L and the medial rail 132M) is/are configured to suspend a bottom surface 130S of the heel engaging component 130 above the horizontal support surface S. In this open configuration 140O, an activator portion (e.g., the tab to be engaged by the wearer) of the release mechanism 152 is disposed between the bottom surface 130S of the heel engaging component 130 and the horizontal support surface S and is located at a rear heel area of the footwear 1000.

As still an additional or alternative example, the locking system may constitute one or more spring loaded pegs, e.g., formed in the bottom surface 130S of heel engaging component 130, that fit into corresponding recess(es), e.g., formed in the top surface of base component 122, in the closed/locked configuration. Additionally or alternatively, the spring loaded peg(s) may be provided in the top surface of base component 122 and extend into corresponding recess(es) formed in the bottom surface 130S of the heel engaging component 130. Such spring loaded peg/recess combinations may be provided on other parts in an overall footwear structure as well.

In some examples of footwear 1000 structures in accordance with aspects of this technology, when released/unlocked from the closed configuration 140C, the entire heel engaging component 130 may be removed from the remainder of the article of footwear 1000 (e.g., rails 132L, 132M may completely pull out of tracks 124L, 124M, respectively). Such an arrangement, if desired, may allow conversion of the article of footwear 1000 between a "closed" shoe structure and an "open" shoe structure as shown in FIG. 1G (e.g., having an open back slipper, clog, mule, or flip-flop type structure). This structure of FIG. 1G includes the upper 102, base component 122, and/or sole structure 110, e.g., as described above.

For other users and/or uses, however, a completely removable heel engaging component 130 might be undesirable. For example, for footwear used in many athletic activities, it would not be desirable to have an open back configuration like that shown in FIG. 1G. Also, complete separability of the heel engaging component 130 from the remainder of the footwear 1000 structure may make the separable parts more susceptible to misplacement, loss, or damage. Thus, in some examples of footwear 1000 structures in accordance with aspects of this technology, a stop system may be provided to prevent complete separation of the heel engaging component 130 from the remainder of the article of footwear 1000 when the article of footwear 1000 is in the open configuration 140O (e.g., rails 132L, 132M may be "stopped" from completely pulling out of tracks 124L, 124M, respectively). As non-limiting examples, the stop system may include one or more of any one or more of the following: (a) a retaining element (e.g., spring loaded) that fits into a recess provided in a rail of the heel-engaging component (e.g., with an activator to release the retaining element from the recess); (b) one or more retaining straps; (c) one or more tethers; (d) an enlarged dimension of a rail (e.g., an enlarged free end) that abuts/contacts a portion of a wall of a track to stop further movement of the rail with respect to the track; (e) a narrowed interior wall of a track that abuts/contacts a portion of a rail to stop further movement of the rail with respect to the track; and/or (f) one or more stop systems of the types described in conjunction with FIGS. 1H-1L.

Any desired type of stop system may be provided without departing from this technology, such as retaining straps that limit rearward movement of the heel engaging component 130 with respect to the forward portion of the upper 102 (and/or with respect to the base components 122 and/or track components (e.g., 124L, 124M)). Tether straps also may be provided that secure the heel engaging component 130 to the forward portion of the upper 102 (and/or to the base components 122 and/or track components (e.g., 124L, 124M)). As another alternative, if desired, the free ends 132E of the rails 132L, 132M may have at least one larger dimension than spacing between at least a portion of the interior walls of the tracks 124L, 124M, respectively, to act as "stops" to prevent the rails 132L, 132M from pulling out of the tracks 124L, 124M. As another example alternative or additional feature, if desired, the interior spacing between a portion of the interior walls of the tracks 124L, 124M may have a narrowed portion in at least one dimension that catches a larger free end 132E and/or other enlarged portion of rails 132L, 132M, respectively, to stop complete separation.

FIGS. 1H-1L illustrate another example stop system 160 (and/or a stop system/locking system combination) that may be used in articles of footwear 1000 in accordance with at least some examples of this technology. FIGS. 1H, 1K, and 1L show that at least one rail 132L, 132M includes a recess 162 located toward its forward or free end 132E (a similar and corresponding recess 162 in rail 132M is not visible in the view of FIG. 1H). A spring 164 loaded retaining element 166 extends into the interior of the track(s) 124L and/or 124M, and the spring 164 biases the retaining element 166 in a direction toward the interior of the track 124L, 124M. This spring 164 loaded retaining element 166 may be moved (e.g., up and down in the view of FIGS. 1K and 1L) by user interaction with an activator 168.

FIG. 1K shows this example stop system 160 unactivated with the heel engaging component 130 in the closed configuration 140C. In this configuration, the lateral side rail 132L and the medial side rail 132M are inserted into the lateral side track 124L and the medial side track 124M, respectively, and the heel engaging component 130 is locked in place (e.g., by one or more of the locking systems described above). In this closed configuration 140C, the spring 164 pushes the retaining element 166 against an outer surface of the rail 132L, 132M.

When the locking system is released (e.g., by user interaction with the activator or release mechanism 152, by releasing straps 142 from fasteners 144, and/or in another appropriate manner), the biasing force F of spring 138L, 138M pushes the lateral side rail 132L and the medial side rail 132M rearward (see force arrow F in FIG. 1L). When the recess 162 reaches the location of retaining element 166, the biasing force of the spring 164 pushes the retaining element 166 into the recess 162. When the end wall 162W of the recess 162 reaches the retaining element 166, the retaining element 166 engages the end wall 162W (which may be substantially parallel to the surface of retaining element 166) and stops further rearward movement of the lateral side rail 132L and the medial side rail 132M with respect to the lateral side track 124L and the medial side track 124M, respectively. See FIG. 1L. The heel engaging component 130 is now in the open configuration 140O and stopped from pulling out of the track component 124L, 124M.

If desired, the recess 162 may include a sloped interior wall 162S that is shaped to allow the lateral side rail 132L and the medial side rail 132M to be slid forward toward and/or to the closed configuration 140C. More specifically, as the heel engaging component 130 is pushed toward the closed position 140C by the user, that forward pushing force will cause the retaining element 166 to move downward as the sloped wall 162S slides forward until the retaining element 166 exits the recess 162 (and the stopping system returns to the configuration shown in FIG. 1K). This type of arrangement would allow the heel engaging component 130 to be moved to the closed configuration 140C without user interaction with the activator 168.

The retaining element 166 may be operatively engaged with the activator 168, e.g., in a manner so that force on the activator 168 will cause the retaining element 166 to retract outward with respect to the recess 162 against the biasing force of spring 164 (e.g., downward to/toward the location shown in FIG. 1K). When retracted in this manner, if desired, the lateral side rail 132L and the medial side rail 132M may be completely removed from the lateral side track 124L and the medial side track 124M, respectively, because the retracted retaining element 166 will not catch the end wall 162W of the recess 162. Thus, this stop system 160 structure allows the heel engaging component 130 to be completely removed from the upper 102 and/or base component 122 and/or sole structure 110, if desired, but it requires additional user interaction with the stop system 160 to do so. This may be advantageous, for example, to prevent an unplanned disengagement of the heel engaging component 130 from the upper 102 and/or base component 122 and/or sole structure 110, but to allow a planned disengagement of these parts, e.g., to clean or replace the heel engaging component 130 and/or parts thereof.

Additionally or alternatively, if desired, rather than having a sloping wall 162S, the recess 162 could have its side wall opposite end wall 162W shaped similar to end wall 162W (e.g., so that the recess 162 is substantially cylindrical (e.g., rectangular or circular in cross section) in shape). In such a stop system 160, once the retaining element 166 is lodged within the recess 162 in the open configuration 140O, the user must interact with the activator 168 to move the lateral side rail 132L and/or the medial side rail 132M with respect to the lateral side track 124L and/or the medial side track 124M, respectively, in either (a) the forward direction (to or toward the closed configuration 140C) or (b) the rearward direction (to be completely removed from the upper 102 and/or base component 122 and/or sole structure 110, if so constructed).

The activator 168 may be operatively engaged with the retaining element 166 in any desired manner without departing from the technology. As one example, the activator 168 may be engaged with one or more arms (shown generally in broken lines in FIGS. 1K and 1L) that extend around the side rail 132L, 132M (and may extend around and/or through the respective track 124L, 124M) to engage the retaining element 166 and/or spring 164. In this arrangement, motion of the activator 168 directly translates to the same general corresponding motion of the retaining element 166 (e.g., upward and downward motion in the orientations of FIGS. 1K and 1L). Other arrangements, mechanical linkages, and/or other connections between the activator 168 and the retaining element 166 may be used to provide the desired motion and action.

As an alternative or additional "locking system" to those described above, the locking system for the rear heel component 130 could at least in part include a recess 162, spring 164, retaining element 166, and activator 168 arrangement like that shown in FIGS. 1H-1L. In that instance: (a) another activator 168, spring 164, and retaining element 166 set may be provided forward of the location shown in FIGS. 1H-1J (e.g., near or nearer to the free end 132E, as shown in broken lines at the right side of FIG. 1K) and/or another recess 162 may be provided on the rail(s) 132L, 132M rearward of the recess 162 shown (further from the free end 132E), to hold the rail(s) 132L, 132M at the closed position. Such a locking system including an activator 168, retaining element 166, and spring 164 set may function in the manner shown and described above in conjunction with FIGS. 1K and 1L.

FIGS. 2A and 2B illustrate additional features of articles of footwear 1000 in accordance with at least some examples of this technology. As shown in these figures, with the article of footwear 1000 supported in an upright position on the ground-contacting surface of the sole structure 110 on a horizontal support surface S, at least a portion of the lateral side track 124L (FIG. 2A) and/or at least a portion of the medial side track 124M (FIG. 2B) will extend upward and rearward. In this illustrated example, at least a portion of the lateral side track 124L and/or at least a portion of the medial side track 124M (formed as part of the base component 122) extend upward and rearward at a first angle $\alpha$ between 5° and 25° (i.e., between 5 degrees and 25 degrees) with respect to the horizontal support surface S and/or other horizontal plane. This first angle $\alpha$ may be between 6° and 20° (i.e., between 6 degrees and 20 degrees), and some examples, between 7° and 16° (i.e., between 7 degrees and 16 degrees), or even between 7.5° and 15° (i.e., between 7.5 degrees and 15 degrees). Similarly, in this same upright and supported position, at least portions of the lateral side rail 132L and/or the medial side rail 132M may extend upward and rearward within any of these same angular ranges. If desired, on a single footwear 1000 structure, the lateral side track 124L and/or the lateral side rail 132L may extend at the same angles from the horizontal base surface S as the medial side track 124M and/or the medial side rail 132M.

Additionally or alternatively, if desired, as also shown in FIGS. 2A and 2B, the sole structure 110, base component 122 (if any), upper portion 102, and/or heel engaging component 130 (e.g., including tracks 124L and/or 124M and/or rails 132L and/or 132M) may be sized, shaped, and configured so that, with the article of footwear 1000 supported in an upright position on the ground-contacting surface of the sole structure 110 on a horizontal support surface S in the open configuration 140O, a rearmost bottom 138B of the heel engaging component 130 is suspended above the horizontal support surface S by a distance D of at least 1.5 inches. In some examples of this technology, this distance D may be at least 1.25 inches, at least 2 inches, at least 2.25 inches, or even at least 2.5 inches.

These angle $\alpha$ and/or suspension distance D features are useful in at least some examples of this technology, if desired, to provide a "hands-free" mode of operation. For example, as shown in FIG. 3, when the locking system's release 152 activator is located at a rear heel area of the footwear 1000, these angle $\alpha$ and/or suspension distance D features may allow sufficient room so that the release 152 activator can be engaged by a toe portion of the wearer's other foot F2. When the release 152 is activated, the biasing force of springs 138L, 138M will automatically push the heel engaging component 130 rearward and upward along rails 124L, 124R. The angle $\alpha$ and/or suspension distance D features allow sufficient space between the bottom surface 130S of the heel engaging component 130 and the support surface S so that the rearwardly extending heel engaging component 130 will clear the top of the wearer's other foot F2/shoe. Also, when a stop system 160 like that described above is used (e.g., with a slope wall 162S in a stop system recess 162), the foot can be secured in the upper 102 by pushing the rear surface of the heel engaging component 130 forwardly (and downwardly) along rails 124L, 124R, e.g., with the other foot F2, e.g., until the heel engaging component 130 is located sufficiently forward so that the retaining member 150 returns to its position to lock the heel engaging component 130 in the closed configuration 140C and/or so that another locking system is/can be engaged manually or automatically (including the broken line version of the locking system shown at the right hand side of FIG. 1K).

Rather than a rearmost heel location, if desired, the locking system release 152 activator may be located toward a side heel area of the article of footwear 1000, e.g., slightly offset from the rearmost heel location, e.g., toward the medial side or lateral side (e.g., between perpendicular planes located at P=0.01L to 0.15L, or even between perpendicular planes located at P=0.02L to 0.1L). This offset location may allow more comfortable and easy interaction between the wearer's other foot F2 and the release 152 activator.

Further, as some non-limiting examples, the locking system may include one or more of any one or more of the following: (a) a retaining element (e.g., spring loaded peg) that fits into a recess provided in a rail of the heel-engaging component (e.g., with an activator to release the retaining element from the recess); (b) a retaining element (e.g., spring loaded peg) mounted on a sole component and/or an upper component that fits into a recess provided in the heel-engaging component; (c) a retaining element (e.g., spring loaded) mounted on the heel engaging component that fits into a recess provided in a sole component and/or an upper component; (d) one or more locking systems of the types described in conjunction with FIGS. 1H-1L; (e) one or more straps that extend from the heel engaging component and releasably engage a connector provided on an upper component and/or a sole component (e.g., releasably engaged via a buckle, snap, hook-and-loop fastener, button, magnetic connector, zipper, etc.); (f) one or more straps that extend from an upper component and/or a sole component and releasably engage a connector provided on the heel engaging component (e.g., releasably engaged via a buckle, snap, hook-and-loop fastener, button, magnetic connector, zipper, etc.); and/or (g) a physical retaining part (optionally including a release mechanism, such as a spring loaded pivot release).

Many variations and/or combinations of the specific structures and/or features described above may be used without departing from this technology. As one specific example, if desired, one or more track(s) 124L, 124M (blind or open holes) could be provided on the heel engaging component 130 and those track(s) 124L, 124M could receive one or more rail(s) 132L, 132M provided on the base component 122, upper 102, and/or sole structure 110. Multiple rails and/or tracks may be provided on each side of the article of footwear 1000 in a variety of different combinations. One side of the heel engaging component 130 could include a track while the other side includes a rail that engages corresponding complementary parts on the base component 122, upper 102, and/or sole structure 110. Additionally or alternatively, many different types of mechanical linkages and/or structures can be used, e.g., for the locking system, stop system, their activators, and/or their component parts.

III. Conclusion

The present invention is disclosed above and in the accompanying drawings with reference to a variety of embodiments and/or alternatives. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

For the avoidance of doubt, the present application includes at least the subject matter described in the following numbered Clauses:

Clause 1. An article of footwear, comprising:

an upper portion formed of one or more parts, wherein the upper portion includes a lateral side and a medial side, and wherein the upper portion at least partially defines a front part of a foot-receiving chamber for the article of footwear;

a lateral side track extending along the lateral side of the upper portion;

a medial side track extending along the medial side of the upper portion; and a heel engaging component including: (a) a lateral rail that is movably engaged with respect to the lateral side track, (b) a medial rail that is movably engaged with respect to the medial side track, and (c) a rear component extending between the lateral rail and the medial rail, wherein the heel engaging component is movable between a closed configuration and an open configuration by moving the lateral rail with respect to the lateral side track and by moving the medial rail with respect to the medial side track.

Clause 2. The article of footwear according to Clause 1, further comprising: a locking system having a part engaging the heel engaging component to hold the heel engaging component in the closed configuration, e.g., wherein the locking system may include one or more of any one or more of the following: (a) a retaining element (e.g., spring loaded peg) that fits into a recess provided in a rail of the heel-engaging component (e.g., with an activator to release the retaining element from the recess); (b) a retaining element (e.g., spring loaded peg) mounted on a sole component and/or an upper component that fits into a recess provided in the heel-engaging component; (c) a retaining element (e.g., spring loaded) mounted on the heel engaging component that fits into a recess provided in a sole component and/or an upper component; (d) one or more locking systems of the types described in conjunction with FIGS. 1H-1L; (e) one or more straps that extend from the heel engaging component and releasably engage a connector provided on an upper component and/or a sole component (e.g., releasably engaged via a buckle, snap, hook-and-loop fastener, button, magnetic connector, zipper, etc.); (f) one or more straps that extend from an upper component and/or a sole component and releasably engage a connector provided on the heel engaging component (e.g., releasably engaged via a buckle, snap, hook-and-loop fastener, button, magnetic connector, zipper, etc.); and/or (g) a physical retaining part (optionally including a release mechanism, such as a spring loaded pivot release).

Clause 3. The article of footwear according to Clause 2, wherein the locking system includes a release mechanism located at a rear heel area of the article of footwear.

Clause 4. The article of footwear according to Clause 3, further comprising: a sole structure providing a ground-contacting surface for the article of footwear and engaged with at least one of the upper portion, the lateral side track, the medial side track, or the heel engaging component, wherein, with the article of footwear supported in an upright position on the ground-contacting surface of the sole structure on a horizontal support surface and in the open configuration, a rearmost part of a bottom surface of the heel engaging component is suspended above the horizontal support surface, and wherein an activator portion of the release mechanism is disposed between the bottom surface of the heel engaging component and the horizontal support surface.

Clause 5. The article of footwear according to any one of Clauses 1 to 4, further comprising: a biasing system that applies a biasing force to the heel engaging component, wherein the biasing force is applied in a direction to move the heel engaging component from the closed configuration to the open configuration, e.g., wherein the biasing system may include one or more of any one or more of the following: (a) a coil spring, (b) a leaf spring, (c) a torsion spring, (d) a flat spring, and/or (e) a resilient member (e.g., a compressible resilient member made from one or more of: (i) a foam material, (ii) a rigid but flexible material (such as plastic materials, non-foam plastic materials, thermoplastic materials, thermosetting materials, polyether block amide materials, fiber reinforced plastic materials etc.), etc.).

Clause 6. The article of footwear according to Clause 5, wherein the biasing system includes a lateral spring member engaging the lateral rail, wherein the lateral spring member applies a force to the lateral rail in a direction to push the heel engaging component toward the open configuration.

Clause 7. The article of footwear according to Clause 5 or 6, wherein the biasing system includes a medial spring member engaging the medial rail, wherein the medial spring member applies a force to the medial rail in a direction to push the heel engaging component toward the open configuration.

Clause 8. The article of footwear according to any one of Clauses 1 to 7, further comprising: a stop system that prevents at least one of: (a) the lateral rail from being completely disengaged from the lateral side track and (b) the medial rail from being completely disengaged from the medial side track, e.g., wherein the stop system may include one or more of any one or more of the following: (a) a retaining element (e.g., spring loaded) that fits into a recess provided in a rail of the heel-engaging component (e.g., with an activator to release the retaining element from the recess); (b) one or more retaining straps; (c) one or more tethers; (d) an enlarged dimension of a rail (e.g., an enlarged free end) that abuts/contacts a portion of a wall of a track to stop further movement of the rail with respect to the track; (e) a narrowed interior wall of a track that abuts/contacts a portion of a rail to stop further movement of the rail with respect to the track; and/or (f) one or more stop systems of the types described in conjunction with FIGS. 1H-1L.

Clause 9. The article of footwear according to any one of Clauses 1 to 7, further comprising: (a) a lateral stop system that prevents the lateral rail from being completely disengaged from the lateral side track; and (b) a medial stop system that prevents the medial rail from being completely disengaged from the medial side track.

Clause 10. The article of footwear according to any one of Clauses 1 to 9, further comprising: a sole structure providing a ground-contacting surface for the article of footwear and engaged with at least one of the upper portion, the lateral side track, the medial side track, or the heel engaging component, wherein, with the article of footwear supported in an upright position on the ground-contacting surface of the sole structure on a horizontal support surface, at least a portion of the lateral side track extends upward and rearward at a first angle between 5° and 25° with respect to the horizontal support surface.

Clause 11. The article of footwear according to Clause 10, wherein the first angle is between 6° and 20°.

Clause 12. The article of footwear according to Clause 10, wherein the first angle is between 7° and 16°.

Clause 13. The article of footwear according to Clause 10, wherein the first angle is between 7.5° and 15°.

Clause 14. The article of footwear according to any one of Clauses 10 to 13, wherein, with the article of footwear supported in the upright position on the ground-contacting surface of the sole structure on the horizontal support surface, at least a portion of the medial side track extends upward and rearward at a second angle between 5° and 25° with respect to the horizontal support surface.

Clause 15. The article of footwear according to Clause 14, wherein the second angle is between 6° and 20°.

Clause 16. The article of footwear according to Clause 14, wherein the second angle is between 7° and 16°.

Clause 17. The article of footwear according to Clause 14, wherein the second angle is between 7.5° and 15°.

Clause 18. The article of footwear according to any one of Clauses 1 to 9, further comprising: a sole structure providing a ground-contacting surface for the article of footwear and engaged with at least one of the upper portion, the lateral side track, the medial side track, or the heel engaging component, wherein, with the article of footwear supported in an upright position on the ground-contacting surface of the sole structure on a horizontal support surface, at least a portion of the medial side track extends upward and rearward at a first angle between 5° and 25° with respect to the horizontal support surface.

Clause 19. The article of footwear according to Clause 18, wherein the first angle is between 6° and 20°.

Clause 20. The article of footwear according to Clause 18, wherein the first angle is between 7° and 16°.

Clause 21. The article of footwear according to Clause 18, wherein the first angle is between 7.5° and 15°.

Clause 22. The article of footwear according to any one of Clauses 1 to 9, further comprising: a sole structure providing a ground-contacting surface for the article of footwear and engaged with at least one of the upper portion, the lateral side track, the medial side track, or the heel engaging component, wherein, with the article of footwear supported in an upright position on the ground-contacting surface of the sole structure on a horizontal support surface and in the open configuration, a rearmost bottom of the heel engaging component is suspended above the horizontal support surface by a distance of at least 1.5 inches.

Clause 23. The article of footwear according to Clause 22, wherein the distance is at least 2 inches.

Clause 24. The article of footwear according to Clause 22, wherein the distance is at least 2.25 inches.

Clause 25. The article of footwear according to any one of Clauses 1 to 24, wherein the lateral side track includes, at least in part, an opening defined in a lateral footwear component that is engaged with the upper portion.

Clause 26. The article of footwear according to any one of Clauses 1 to 25, wherein the medial side track includes, at least in part, an opening defined in a medial footwear component that is engaged with the upper portion.

Clause 27. The article of footwear according to any one of Clauses 1 to 24, wherein the lateral side track and the medial side track are formed on opposite sides of a footwear component with which the upper portion is engaged.

Clause 28. The article of footwear according to Clause 27, wherein the footwear component is made from a rigid material.

Clause 29. The article of footwear according to Clause 27, wherein the footwear component is made from one or more materials selected from the group consisting of: plastic materials, non-foam plastic materials, thermoplastic materials, thermosetting materials, polyether block amide materials, fiber reinforced plastic materials, and metal or metal alloy materials.

Clause 30. The article of footwear according to any one of Clauses 27 to 29, further comprising: an impact-force attenuating component engaged with the footwear component.

Clause 31. The article of footwear according to Clause 30, wherein the impact-force attenuating component includes at least one of: one or more fluid-filled bladders, one or more foam components, and one or more shock absorbing components.

Clause 32. The article of footwear according to any one of Clauses 27 to 29, further comprising: a sole structure engaged with the footwear component.

Clause 33. An article of footwear, comprising:

an upper portion formed of one or more parts, wherein the upper portion includes a lateral side and a medial side, and wherein the upper portion at least partially defines a front part of a foot-receiving chamber for the article of footwear;

a track component integrally formed or engaged with the upper portion;

a heel engaging component movable with respect to the upper portion via the track component between a closed configuration and an open configuration; and a sole structure providing a ground-contacting surface for the article of footwear and engaged with at least one of the upper portion, the track component, or the heel engaging component, wherein, with the article of footwear supported in an upright position on the ground-contacting surface of the sole structure on a horizontal support surface, the track component is configured to support movement of the heel engaging component upward and rearward when changing from the closed configuration to the open configuration.

Clause 34. The article of footwear according to Clause 33, wherein when changing from the closed configuration to the open configuration and supported on the horizontal support surface in the upright position, the track component is configured to support movement of the heel engaging component upward and rearward at an angle between 5° and 25° with respect to the horizontal support surface.

Clause 35. The article of footwear according to Clause 34, wherein the angle is between 6° and 20°.

Clause 36. The article of footwear according to Clause 34, wherein the angle is between 7° and 16°.

Clause 37. The article of footwear according to Clause 34, wherein the angle is between 7.5° and 15°.

Clause 38. The article of footwear according to any one of Clauses 33 to 37, further comprising: a locking system having a part engaging the heel engaging component to hold the heel engaging component in the closed configuration, e.g., wherein the locking system may include one or more of any one or more of the following: (a) a retaining element (e.g., spring loaded peg) that fits into a recess provided in a rail of the heel-engaging component (e.g., with an activator to release the retaining element from the recess); (b) a retaining element (e.g., spring loaded peg) mounted on a sole component and/or an upper component that fits into a recess provided in the heel-engaging component; (c) a retaining element (e.g., spring loaded) mounted on the heel engaging component that fits into a recess provided in a sole component and/or an upper component; (d) one or more locking systems of the types described in conjunction with FIGS. 1H-1L; (e) one or more straps that extend from the heel engaging component and releasably engage a connector provided on an upper component and/or a sole component (e.g., releasably engaged via a buckle, snap, hook-and-loop fastener, button, magnetic connector, zipper, etc.); (f) one or more straps that extend from an upper component and/or a sole component and releasably engage a connector provided on the heel engaging component (e.g., releasably engaged via a buckle, snap, hook-and-loop fastener, button, magnetic connector, zipper, etc.); and/or (g) a physical retaining part (optionally including a release mechanism, such as a spring loaded pivot release).

Clause 39. The article of footwear according to Clause 38, wherein the locking system includes a release mechanism located at a rear heel area of the article of footwear.

Clause 40. The article of footwear according to Clause 39, wherein, with the article of footwear supported in the upright position on the ground-contacting surface of the sole structure on the horizontal support surface and in the open configuration, a rearmost part of a bottom surface of the heel engaging component is suspended above the horizontal support surface, and wherein an activator portion of the release mechanism is disposed between the bottom surface of the heel engaging component and the horizontal support surface.

Clause 41. The article of footwear according to any one of Clauses 33 to 40, further comprising: a biasing system that applies a biasing force to the heel engaging component, wherein the biasing force is applied in a direction to move the heel engaging component from the closed configuration to the open configuration, e.g., wherein the biasing system may include one or more of any one or more of the following: (a) a coil spring, (b) a leaf spring, (c) a torsion spring, (d) a flat spring, and/or (e) a resilient member (e.g., a compressible resilient member made from one or more of: (i) a foam material, (ii) a rigid but flexible material (such as plastic materials, non-foam plastic materials, thermoplastic materials, thermosetting materials, polyether block amide materials, fiber reinforced plastic materials etc.), etc.).

Clause 42. The article of footwear according to Clause 41, wherein the biasing system includes a first spring member engaging the heel engaging component and the track component, wherein the first spring member applies a force to push the heel engaging component toward the open configuration.

Clause 43. The article of footwear according to Clause 42, wherein the biasing system includes a second spring member engaging the heel engaging component and the track component, wherein the second spring member applies a force to push the heel engaging component toward the open configuration.

Clause 44. The article of footwear according to any one of Clauses 33 to 43, further comprising: a stop system that prevents the heel engaging component from being completely disengaged from the track component, e.g., wherein the stop system may include one or more of any one or more of the following: (a) a retaining element (e.g., spring loaded) that fits into a recess provided in a rail of the heel-engaging component (e.g., with an activator to release the retaining element from the recess); (b) one or more retaining straps; (c) one or more tethers; (d) an enlarged dimension of a rail (e.g., an enlarged free end) that abuts/contacts a portion of a wall of a track to stop further movement of the rail with respect to the track; (e) a narrowed interior wall of a track that abuts/contacts a portion of a rail to stop further movement of the rail with respect to the track; and/or (f) one or more stop systems of the types described in conjunction with FIGS. 1H-1L.

Clause 45. The article of footwear according to Clause 44, wherein the stop system includes a lateral side stop member and a medial side stop member.

Clause 46. The article of footwear according to any one of Clauses 33 to 45, wherein, with the article of footwear supported in the upright position on the ground-contacting surface of the sole structure on the horizontal support surface and in the open configuration, a rearmost bottom of the heel engaging component is suspended above the horizontal support surface by a distance of at least 1.5 inches.

Clause 47. The article of footwear according to Clause 46, wherein the distance is at least 2 inches.

Clause 48. The article of footwear according to Clause 46, wherein the distance is at least 2.25 inches.

Clause 49. The article of footwear according to any one of Clauses 33 to 48, wherein the track component includes, at least in part, a lateral side opening defined in a lateral footwear component that is engaged with the upper portion.

Clause 50. The article of footwear according to any one of Clauses 33 to 49, wherein the track component includes, at least in part, a medial side opening defined in a medial footwear component that is engaged with the upper portion.

Clause 51. The article of footwear according to any one of Clauses 33 to 48, wherein the track component includes a lateral side track and a medial side track formed on opposite sides of a footwear component with which the upper portion is engaged.

Clause 52. An article of footwear, comprising:

an upper portion formed of one or more parts, wherein the upper portion includes a lateral side and a medial side, and wherein the upper portion at least partially defines a front part of a foot-receiving chamber for the article of footwear;

a track component integrally formed or engaged with the upper portion;

a heel engaging component movable with respect to the upper portion via the track component between a closed configuration and an open configuration;

a locking system having a part engaging the heel engaging component to hold the heel engaging component in the closed configuration, wherein the locking system includes a release mechanism located at a rear heel area of the article of footwear; and a sole structure providing a ground-contacting surface for the article of footwear and engaged with at least one of the upper portion, the track component, the heel engaging component, or the locking system, wherein, with the article of footwear supported in an upright position on the ground-contacting surface of the sole structure on a horizontal support surface and in the open configuration, the track component is configured to suspend a bottom surface of the heel engaging component above the horizontal support surface, and wherein an activator portion of the release mechanism is disposed between the bottom surface of the heel engaging component and the horizontal support surface. As non-limiting examples, the locking system may include one or more of any one or more of the following: (a) a retaining element (e.g., spring loaded peg) that fits into a recess provided in a rail of the heel-engaging component (e.g., with an activator to release the retaining element from the recess); (b) a retaining element (e.g., spring loaded peg) mounted on a sole component and/or an upper component that fits into a recess provided in the heel-engaging component; (c) a retaining element (e.g., spring loaded) mounted on the heel engaging component that fits into a recess provided in a sole component and/or an upper component; (d) one or more locking systems of the types described in conjunction with FIGS. 1H-1L; (e) one or more straps that extend from the heel engaging component and releasably engage a connector provided on an upper component and/or a sole component (e.g., releasably engaged via a buckle, snap, hook-and-loop fastener, button, magnetic connector, zipper, etc.); (f) one or more straps that extend from an upper component and/or a sole component and releasably engage a connector provided on the heel engaging component (e.g., releasably engaged via a buckle, snap, hook-and-loop fastener, button, magnetic connector, zipper, etc.); and/or (g) a physical retaining part (optionally including a release mechanism, such as a spring loaded pivot release).

Clause 53. The article of footwear according to Clause 52, wherein with the article of footwear supported in the upright position on the ground-contacting surface of the sole structure on the horizontal support surface and in the open configuration, a rearmost part of the bottom surface of the heel engaging component is suspended above the horizontal support surface by a distance of at least 1.5 inches.

Clause 54. The article of footwear according to Clause 52 or 53, further comprising: a biasing system that applies a biasing force to the heel engaging component, wherein the biasing force is applied in a direction to move the heel engaging component from the closed configuration to the open configuration, e.g., wherein the biasing system may include one or more of any one or more of the following: (a) a coil spring, (b) a leaf spring, (c) a torsion spring, (d) a flat spring, and/or (e) a resilient member (e.g., a compressible resilient member made from one or more of: (i) a foam material, (ii) a rigid but flexible material (such as plastic materials, non-foam plastic materials, thermoplastic materials, thermosetting materials, polyether block amide materials, fiber reinforced plastic materials etc.), etc.).

Clause 55. The article of footwear according to Clause 54, wherein the biasing system includes a first spring member engaging the heel engaging component and the track component, wherein the first spring member applies a force to push the heel engaging component toward the open configuration.

Clause 56. The article of footwear according to Clause 55, wherein the biasing system includes a second spring member engaging the heel engaging component and the track component, wherein the second spring member applies a force to push the heel engaging component toward the open configuration.

Clause 57. The article of footwear according to any one of Clauses 52 to 56, further comprising: a stop system that prevents the heel engaging component from being completely disengaged from the track component, e.g., wherein the stop system may include one or more of any one or more of the following: (a) a retaining element (e.g., spring loaded) that fits into a recess provided in a rail of the heel-engaging component (e.g., with an activator to release the retaining element from the recess); (b) one or more retaining straps; (c) one or more tethers; (d) an enlarged dimension of a rail (e.g., an enlarged free end) that abuts/contacts a portion of a wall of a track to stop further movement of the rail with respect to the track; (e) a narrowed interior wall of a track that abuts/contacts a portion of a rail to stop further movement of the rail with respect to the track; and/or (f) one or more stop systems of the types described in conjunction with FIGS. 1H-1L.

Clause 58. The article of footwear according to Clause 57, wherein the stop system includes a lateral side stop member and a medial side stop member.

Clause 59. The article of footwear according to any one of Clauses 52 to 58, wherein, with the article of footwear supported in the upright position on the ground-contacting surface of the sole structure on the horizontal support surface and in the open configuration, a rearmost bottom of the heel engaging component is suspended above the horizontal support surface by a distance of at least 1.5 inches.

Clause 60. The article of footwear according to Clause 59, wherein the distance is at least 2 inches.

Clause 61. The article of footwear according to Clause 59, wherein the distance is at least 2.25 inches.

Clause 62. The article of footwear according to any one of Clauses 52 to 61, wherein the track component includes, at least in part, a lateral side opening defined in a lateral footwear component that is engaged with the upper portion.

Clause 63. The article of footwear according to any one of Clauses 52 to 62, wherein the track component includes, at least in part, a medial side opening defined in a medial footwear component that is engaged with the upper portion.

Clause 64. The article of footwear according to any one of Clauses 52 to 61, wherein the track component includes a lateral side track and a medial side track formed on opposite sides of a footwear component with which the upper portion is engaged.

What is claimed is:

1. An article of footwear, comprising:

an upper portion formed of one or more parts, wherein the upper portion includes a lateral side and a medial side, and wherein the upper portion at least partially defines a front part of a foot-receiving chamber for the article of footwear;

a lateral side track extending along the lateral side of the upper portion;

a medial side track extending along the medial side of the upper portion;

a heel engaging component including:

a lateral rail that is movably engaged with respect to the lateral side track, a medial rail that is movably engaged with respect to the medial side track, and a rear component extending between the lateral rail and the medial rail, wherein the heel engaging component is movable between a closed configuration and an open configuration by moving the lateral rail with respect to the lateral side track and by moving the medial rail with respect to the medial side track, and wherein, with the article of footwear supported in an upright position on a horizontal support surface, the lateral side track and the medial side track are configured to support movement of the heel engaging component upward and rearward when changing from the closed configuration to the open configuration;

a lateral stop system that prevents the lateral rail from being completely disengaged from the lateral side track by engaging a lateral retaining element into a portion of the lateral side track; and a medial stop system that prevents the medial rail from being completely disengaged from the medial side track by engaging a medial retaining element into a portion of the medial side track.

2. An article of footwear, comprising:

an upper portion formed of one or more parts, wherein the upper portion includes a lateral side and a medial side, and wherein the upper portion at least partially defines a front part of a foot-receiving chamber for the article of footwear;

a lateral side track extending along the lateral side of the upper portion;

a medial side track extending along the medial side of the upper portion;

a heel engaging component including:

a lateral rail that is movably engaged with respect to the lateral side track, a medial rail that is movably engaged with respect to the medial side track, and a rear component extending between the lateral rail and the medial rail, wherein the heel engaging component is movable between a closed configuration and an open configuration by moving the lateral rail with respect to the lateral side track and by moving the medial rail with respect to the medial side track;

a lateral stop system that prevents the lateral rail from being completely disengaged from the lateral side track by engaging a lateral retaining element into a portion of the lateral side track, wherein the lateral retaining element is spring-loaded and biased in a direction toward the lateral rail and is configured to engage in a lateral recess located on the lateral rail when the heel engaging component moves from the closed configuration to the open configuration; and a medial stop system that prevents the medial rail from being completely disengaged from the medial side track by engaging a medial retaining element into a portion of the medial side track, wherein the medial retaining element is spring-loaded and biased in a direction toward the medial rail and is configured to engage in a medial recess located on the medial rail when the heel engaging component moves from the closed configuration to the open configuration.

3. An article of footwear, comprising:

an upper portion formed of one or more parts, wherein the upper portion includes a lateral side and a medial side, and wherein the upper portion at least partially defines a front part of a foot-receiving chamber for the article of footwear;

a lateral side track extending along the lateral side of the upper portion;

a medial side track extending along the medial side of the upper portion;

a heel engaging component including:

a lateral rail that is movably engaged with respect to the lateral side track, a medial rail that is movably engaged with respect to the medial side track, and a rear component extending between the lateral rail and the medial rail, wherein the heel engaging component is movable between a closed configuration and an open configuration by moving the lateral rail with respect to the lateral side track and by moving the medial rail with respect to the medial side track;

a lateral stop system that prevents the lateral rail from being completely disengaged from the lateral side track by engaging a lateral retaining element into a portion of the lateral side track;

a medial stop system that prevents the medial rail from being completely disengaged from the medial side track by engaging a medial retaining element into a portion of the medial side track; and a locking system having a part engaging the heel engaging component to hold the heel engaging component in the closed configuration.

4. An article of footwear, comprising:

an upper portion formed of one or more parts, wherein the upper portion includes a lateral side and a medial side, and wherein the upper portion at least partially defines a front part of a foot-receiving chamber for the article of footwear;

a lateral side track extending along the lateral side of the upper portion;

a medial side track extending along the medial side of the upper portion;

a heel engaging component including:

a lateral rail that is movably engaged with respect to the lateral side track, a medial rail that is movably engaged with respect to the medial side track, and a rear component extending between the lateral rail and the medial rail, wherein the heel engaging component is movable between a closed configuration and an open configuration by moving the lateral rail with respect to the lateral side track and by moving the medial rail with respect to the medial side track;

a lateral stop system that prevents the lateral rail from being completely disengaged from the lateral side track by engaging a lateral retaining element into a portion of the lateral side track;

a medial stop system that prevents the medial rail from being completely disengaged from the medial side track by engaging a medial retaining element into a portion of the medial side track; and a biasing system that applies a biasing force to the heel engaging component, wherein the biasing force is applied in a direction to move the heel engaging component from the closed configuration to the open configuration, wherein the biasing system includes a lateral spring member engaging the lateral rail and fixed at a closed end of a channel formed by the lateral side track, wherein the lateral spring member applies a force to the lateral rail in a direction to push the heel engaging component toward the open configuration, wherein the biasing system includes a medial spring member engaging the medial rail and fixed at a closed end of a channel formed by the medial side track, and wherein the medial spring member applies a force to the medial rail in a direction to push the heel engaging component toward the open configuration.

5. An article of footwear, comprising:

an upper portion formed of one or more parts, wherein the upper portion includes a lateral side and a medial side, and wherein the upper portion at least partially defines a front part of a foot-receiving chamber for the article of footwear;

a lateral side track extending along the lateral side of the upper portion;

a medial side track extending along the medial side of the upper portion;

a heel engaging component including:

a lateral rail that is movably engaged with respect to the lateral side track, a medial rail that is movably engaged with respect to the medial side track, and a rear component extending between the lateral rail and the medial rail, wherein the heel engaging component is movable between a closed configuration and an open configuration by moving the lateral rail with respect to the lateral side track and by moving the medial rail with respect to the medial side track;

a lateral stop system that prevents the lateral rail from being completely disengaged from the lateral side track by engaging a lateral retaining element into a portion of the lateral side track;

a medial stop system that prevents the medial rail from being completely disengaged from the medial side track by engaging a medial retaining element into a portion of the medial side track; and a sole structure providing a ground-contacting surface for the article of footwear and engaged with at least one of the upper portion, the lateral side track, the medial side track, or the heel engaging component, wherein, with the article of footwear supported in an upright position on the ground-contacting surface of the sole structure on a horizontal support surface: (a) at least a portion of the lateral side track extends upward and rearward at a first angle between 5° and 25° with respect to the horizontal support surface, and (b) at least a portion of the medial side track extends upward and rearward at a second angle between 5° and 25° with respect to the horizontal support surface.

6. An article of footwear, comprising:

an upper portion formed of one or more parts, wherein the upper portion includes a lateral side and a medial side, and wherein the upper portion at least partially defines a front part of a foot-receiving chamber for the article of footwear;

a lateral side track extending along the lateral side of the upper portion;

a medial side track extending along the medial side of the upper portion;

a heel engaging component including:

a lateral rail that is movably engaged with respect to the lateral side track, a medial rail that is movably engaged with respect to the medial side track, and a rear component extending between the lateral rail and the medial rail, wherein the heel engaging component is movable between a closed configuration and an open configuration by moving the lateral rail with respect to the lateral side track and by moving the medial rail with respect to the medial side track;

a lateral stop system that prevents the lateral rail from being completely disengaged from the lateral side track by engaging a lateral retaining element into a portion of the lateral side track;

a medial stop system that prevents the medial rail from being completely disengaged from the medial side track by engaging a medial retaining element into a portion of the medial side track; and a sole structure providing a ground-contacting surface for the article of footwear and engaged with at least one of the upper portion, the lateral side track, the medial side track, or the heel engaging component, wherein, with the article of footwear supported in an upright position on the ground-contacting surface of the sole structure on a horizontal support surface and in the open configuration, a rearmost bottom of the heel engaging component is suspended above the horizontal support surface by a distance of at least 1.5 inches.

7. An article of footwear, comprising:

an upper portion formed of one or more parts, wherein the upper portion includes a lateral side and a medial side, and wherein the upper portion at least partially defines a front part of a foot-receiving chamber for the article of footwear;

a lateral side track extending along the lateral side of the upper portion, wherein the lateral side track includes, at least in part, an opening defined in a lateral footwear component that is engaged with the upper portion;

a medial side track extending along the medial side of the upper portion, wherein the medial side track includes, at least in part, an opening defined in a medial footwear component that is engaged with the upper portion;

a heel engaging component including:

a lateral rail that is movably engaged with respect to the lateral side track, a medial rail that is movably engaged with respect to the medial side track, and a rear component extending between the lateral rail and the medial rail, wherein the heel engaging component is movable between a closed configuration and an open configuration by moving the lateral rail with respect to the lateral side track and by moving the medial rail with respect to the medial side track;

a lateral stop system that prevents the lateral rail from being completely disengaged from the lateral side track by engaging a lateral retaining element into a portion of the lateral side track; and a medial stop system that prevents the medial rail from being completely disengaged from the medial side track by engaging a medial retaining element into a portion of the medial side track.

8. An article of footwear, comprising:

an upper portion formed of one or more parts, wherein the upper portion includes a lateral side and a medial side, and wherein the upper portion at least partially defines a front part of a foot-receiving chamber for the article of footwear;

a track component integrally formed or engaged with the upper portion;

a heel engaging component movable with respect to the upper portion via the track component between a closed configuration and an open configuration;

a sole structure providing a ground-contacting surface for the article of footwear and engaged with at least one of the upper portion, the track component, or the heel engaging component; and a stop system that prevents the heel engaging component from being completely disengaged from the track component by engaging into a portion of the track component as the heel engaging component moves with respect to the upper portion via the track component from the closed configuration to the open configuration, wherein, with the article of footwear supported in an upright position on the ground-contacting surface of the sole structure on a horizontal support surface, the track component is configured to support movement of the heel engaging component upward and rearward when changing from the closed configuration to the open configuration.

9. The article of footwear according to claim 8, wherein the stop system includes a lateral side stop member and a medial side stop member.

10. The article of footwear according to claim 8, wherein the stop system includes a spring-loaded retaining element that is biased in a direction toward the portion of the track component, and wherein the spring-loaded retaining element is configured to engage with the portion of the track component as the heel engaging component moves with respect to the upper portion via the track component from the closed configuration to the open configuration.

11. The article of footwear according to claim 8, wherein when changing from the closed configuration to the open configuration and supported on the horizontal support surface in the upright position, the track component is configured to support movement of the heel engaging component upward and rearward at an angle between 5° and 25° with respect to the horizontal support surface.

12. The article of footwear according to claim 8, further comprising:

a locking system having a part engaging the heel engaging component to hold the heel engaging component in the closed configuration.

13. The article of footwear according to claim 12, wherein the locking system includes a release mechanism located at a rear heel area of the article of footwear.

14. The article of footwear according to claim 8, further comprising:

a biasing system that applies a biasing force to the heel engaging component, wherein the biasing force is applied in a direction to move the heel engaging component from the closed configuration to the open configuration.

15. The article of footwear according to claim 14, wherein the biasing system includes a first spring member engaging the heel engaging component and the track component, wherein the first spring member applies a force to push the heel engaging component toward the open configuration, and wherein the biasing system includes a second spring member engaging the heel engaging component and the track component, wherein the second spring member applies a force to push the heel engaging component toward the open configuration.

16. The article of footwear according to claim 8, wherein the track component includes a lateral side track and a medial side track formed on opposite sides of a footwear component with which the upper portion is engaged, wherein the lateral side track and the medial side track each forms a channel extending from a closed end to an open end in an upward and rearward direction.

17. An article of footwear, comprising:

an upper portion formed of one or more parts, wherein the upper portion includes a lateral side and a medial side, and wherein the upper portion at least partially defines a front part of a foot-receiving chamber for the article of footwear;

a track component integrally formed or engaged with the upper portion;

a heel engaging component movable with respect to the upper portion via the track component between a closed configuration and an open configuration;

a stop system that prevents the heel engaging component from being completely disengaged from the track component by engaging into a portion of the track component as the heel engaging component moves with respect to the upper portion via the track component from the closed configuration and the open configuration; and a sole structure providing a ground-contacting surface for the article of footwear and engaged with at least one of the upper portion, the track component, the heel engaging component, or the stop system, wherein, with the article of footwear supported in an upright position on the ground-contacting surface of the sole structure on a horizontal support surface and in the open configuration, the track component is configured to suspend a bottom surface of the heel engaging component above the horizontal support surface, and wherein, with the article of footwear supported in the upright position on the ground-contacting surface of the sole structure on the horizontal support surface, the track component is configured to support movement of the heel engaging component upward and rearward when changing from the closed configuration to the open configuration.

18. The article of footwear according to claim 17, further comprising:

a biasing system that applies a biasing force to the heel engaging component, wherein the biasing force is applied in a direction to move the heel engaging component from the closed configuration to the open configuration, wherein the biasing system includes: (a) a first spring member engaging the heel engaging component and the track component, wherein the first spring member applies a force to push the heel engaging component toward the open configuration, and (b) a second spring member engaging the heel engaging component and the track component, wherein the second spring member applies a force to push the heel engaging component toward the open configuration.

19. An article of footwear, comprising:

an upper portion formed of one or more parts, wherein the upper portion includes a lateral side and a medial side, and wherein the upper portion at least partially defines a front part of a foot-receiving chamber for the article of footwear;

a track component integrally formed or engaged with the upper portion;

a heel engaging component movable with respect to the upper portion via the track component between a closed configuration and an open configuration;

a stop system that prevents the heel engaging component from being completely disengaged from the track component by engaging into a portion of the track component as the heel engaging component moves with respect to the upper portion via the track component from the closed configuration and the open configuration;

a sole structure providing a ground-contacting surface for the article of footwear and engaged with at least one of the upper portion, the track component, the heel engaging component, or the stop system; and a locking system having a part engaging the heel engaging component to hold the heel engaging component in the closed configuration, wherein the locking system includes a release mechanism located at a rear heel area of the article of footwear, wherein the locking system includes an activator on an outer surface of the track component, and wherein the activator is configured to engage a portion of the heel engaging component in the closed configuration, wherein, with the article of footwear supported in an upright position on the ground-contacting surface of the sole structure on a horizontal support surface and in the open configuration, the track component is configured to suspend a bottom surface of the heel engaging component above the horizontal support surface.

20. An article of footwear, comprising:

an upper portion formed of one or more parts, wherein the upper portion includes a lateral side and a medial side, and wherein the upper portion at least partially defines a front part of a foot-receiving chamber for the article of footwear;

a track component integrally formed or engaged with the upper portion;

a heel engaging component movable with respect to the upper portion via the track component between a closed configuration and an open configuration;

a stop system that prevents the heel engaging component from being completely disengaged from the track component by engaging into a portion of the track component as the heel engaging component moves with respect to the upper portion via the track component from the closed configuration and the open configuration, wherein the stop system includes a spring-loaded retaining element extending into an interior portion of the track component and configured to engage with a recess in a portion of the heel engaging component in the closed configuration; and a sole structure providing a ground-contacting surface for the article of footwear and engaged with at least one of the upper portion, the track component, the heel engaging component, or the stop system, wherein, with the article of footwear supported in an upright position on the ground-contacting surface of the sole structure on a horizontal support surface and in the open configuration, the track component is configured to suspend a bottom surface of the heel engaging component above the horizontal support surface.

* * * * *